United States Patent [19]

Paxton

[11] 4,054,236

[45] Oct. 18, 1977

[54] MACHINE FOR NAILING SLATS ON STRINGERS

[75] Inventor: Gerald C. Paxton, Sanger, Calif.

[73] Assignee: SWF Machinery, Inc., Calif.

[21] Appl. No.: 718,893

[22] Filed: Aug. 30, 1976

[51] Int. Cl.[2] ..... B27F 7/02

[52] U.S. Cl. ..... 227/45; 227/50; 227/100; 227/118

[58] Field of Search ..... 227/1, 40, 44, 45, 48, 227/50, 99, 100, 101, 102, 117, 118

[56] References Cited

U.S. PATENT DOCUMENTS

| | | | |
|---|---|---|---|
| 1,956,935 | 5/1934 | Twomley | 227/118 |
| 2,856,606 | 10/1958 | Richards | 227/117 |
| 3,552,624 | 1/1971 | Dykeman | 227/100 |
| 3,591,067 | 7/1971 | Vial | 227/100 |
| 3,957,191 | 5/1976 | Nelson, Jr. | 227/100 |

*Primary Examiner*—Granville Y. Custer, Jr.

*Attorney, Agent, or Firm*—Huebner & Worrel

[57] ABSTRACT

A machine for nailing elongated slats transversely on elongated stringers having a nailing station; a receiving station; a reversible conveyor extended between said stations; chucks on the conveyor adapted to grasp a plurality of stringers in substantially parallel relation disposed longitudinally of the upper run of the conveyor; a reversible drive for advancing the conveyor toward the nailing station in increments of stepped progression whereby corresponding spaced positions on the stringers are successively disposed in the nailing station; a mechanism for automatically placing slats transversely on the stringers at said spaced positions; a nailing mechanism for nailing the slats to the stringers at said spaced positions on the stringers at the nailing station whereby the stringers are interconnected in spaced substantially parallel relation; and a control for reversing the drive to retract the stringers and slats nailed thereon from the nailing station.

23 Claims, 33 Drawing Figures

Fig. 4
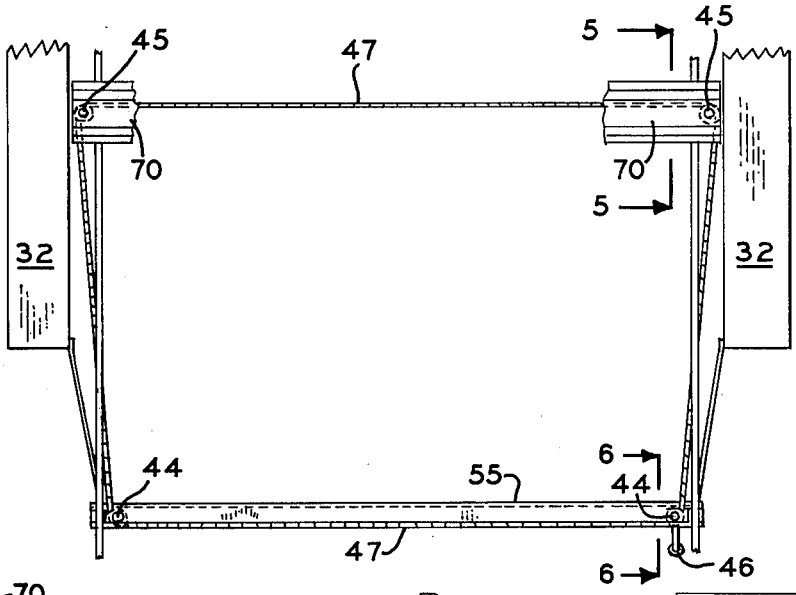
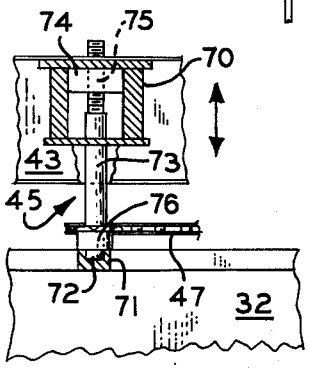
Fig. 5
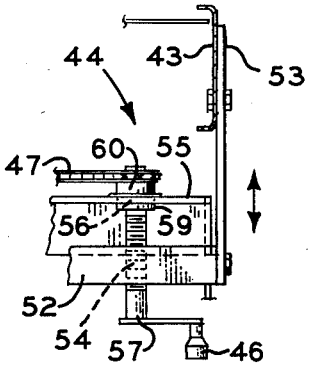
Fig. 7
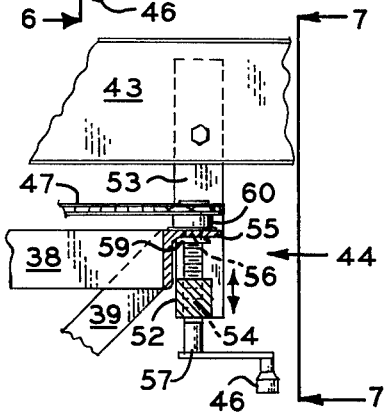
Fig. 6
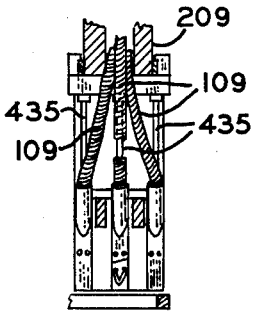
Fig. 18
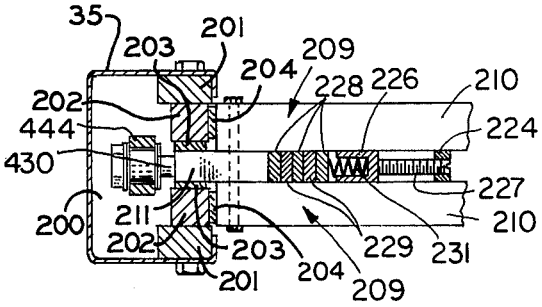
Fig. 19

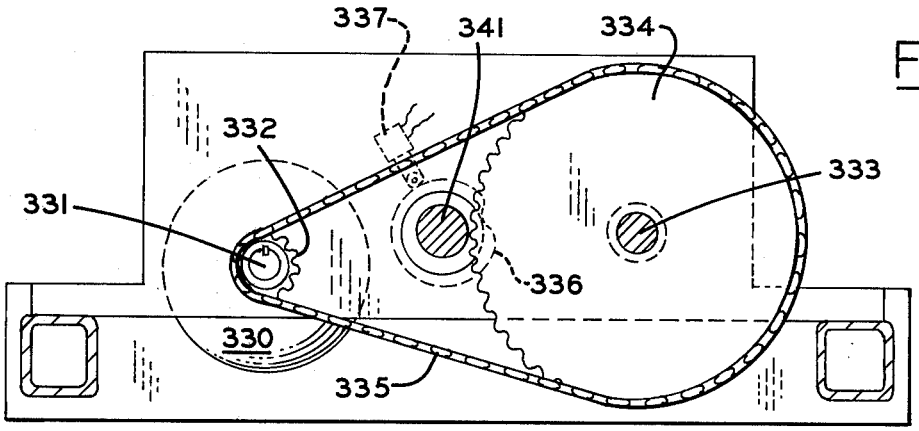
Fig. 10
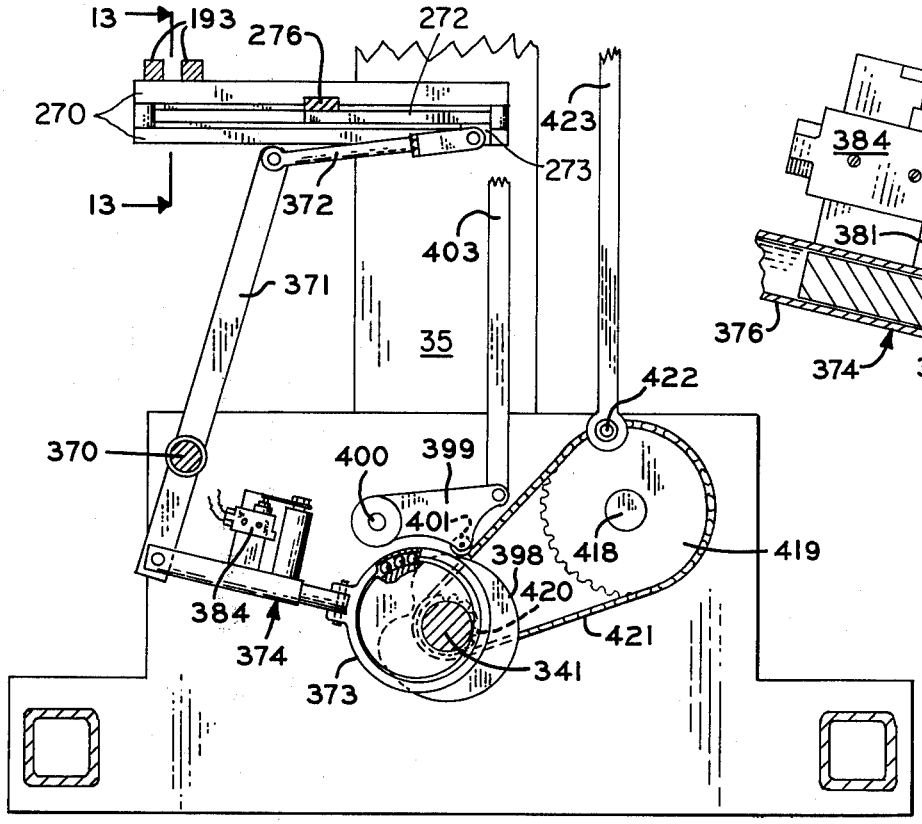
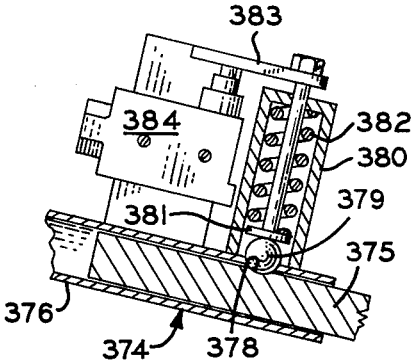
Fig. 12
Fig. 11
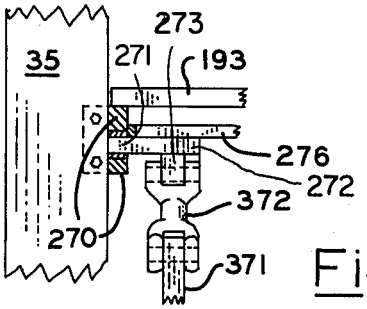
Fig. 13

MACHINE FOR NAILING SLATS ON STRINGERS

BACKGROUND OF THE INVENTION

The present invention relates to a machine for nailing slats transversely on stringers and more particularly to such a machine for fabricating pallets and half pallets.

The present invention resulted from a number of problems which have long confronted the pallet manufacturing industry and is conveniently described in such connection.

The palletizing of loads to be lifted, stacked, stored, transported and otherwise handled long ago revolutionized load handling procedures. Once loads are located on pallets in bins, on racks, or simply stacked, the loads can be conveniently lifted, transported, stacked and unstacked by means of forklifts or the like. The adoption of such procedures has required a vast number of pallets. The rapid deterioration of pallets has lead to heavy demands for replacement. Because of the voluminous need for pallets, their cost has been an important consideration. Nevertheless, because of the difficulties of automated production, many pallets are hand fabricated. Such production is tedious, time consuming and expensive. Generally speaking, the so-called automated mechanisms for the production of pallets have been subject to widely recognized but unsolved difficulties. They have still required excessive hand labor. They have required the hand positioning of slats on their stringers with consequent inefficiencies and inaccuracies. They have duplicated sophisticated nailing equipment in order to nail slats or deck boards on opposite sides of the pallets. They have usually required conveyors to transport stringers to a first nailing station, means for nailing slats on stringers at the first station to form half pallets, a conveyor for transporting the half pallets to a second nailing station, means for nailing slats on the half pallets at the second nailing station, and a conveyor to transport completed pallets from the second nailing station all along a continuous or straight line path. Such conveyors and their appurtenant mechanisms have required expensive floor space in many instances making them inconvenient, expensive, and/or impractical.

These and other problems have long been recognized and their solutions sought by manufacturers of automated fabricating equipment requiring the nailed interconnection of assembled wooden components. U.S. Pat. No. 3,557,439 issued Jan. 26, 1971 on the Dykeman Pallet Assembling System is illustrative of at least one form of the prior art devices.

SUMMARY OF THE INVENTION

An object of the present invention is to provide an improved machine for nailing slats, deck boards and the like transversely on stringers, as in the formation of pallets.

Another object is to provide such a machine which automatically and synchronously delivers stringers and slats to a predetermined nailing station, properly associates the stringers and slats, and nails one to the other in such association.

Another object is to minimize the manual labor required in fabricating pallets and the like.

Another object is to minimize the cost of pallets and other objects requiring the nailed interconnection of slats on stringers.

Another object is to provide a mechanism for automatically nailing slats transversely on stringers which is simpler, is more economical, reduces the attendant manual labor required, requires less floor space, and which accomplishes its fabricating functions more dependably, economically, and speedily than previous devices for the purpose.

A further object is to provide a machine for nailing slats transversely on stringers which is quickly, easily and accurately adjustable to accommodate components of different sizes and arrangements of parts.

Other objects and advantages are to provide improved elements and arrangements thereof in a machine for nailing slats transversely on stringers which is fully effective in accomplishing its intended purposes.

Further objects and advantages will become apparent in the subsequent description in the Specification.

BRIEF DESCRIPTION OF THE DRAWINGS

FIG. 4 is a fragmentary section taken on line 4—4 of FIG. 3.

FIG. 5 is a fragmentary section taken on line 5—5 of FIG. 4.

FIG. 6 is a section taken on line 6—6 of FIG. 4.

FIG. 7 is a section taken on line 7—7 of FIG. 6.

FIG. 10 is a fragmentary longitudinal section of the machine, taken on line 10—10 of FIG. 2.

FIG. 11 is a fragmentary section of a portion of the drive mechanism of the machine, taken on line 11—11 of FIG. 2.

FIG. 12 is an enlarged fragmentary portion of the drive mechanism of FIG. 11 showing a fail safe device utilized therein.

FIG. 13 is a fragmentary section taken on line 13—13 of FIG. 11.

FIG. 18 is a somewhat enlarged fragmentary elevation of a portion of a nail feeding mechanism.

FIG. 19 is a fragmentary horizontal section taken on line 19—19 of FIG. 2.

DESCRIPTION OF THE PREFERRED EMBODIMENT

Figure 3:
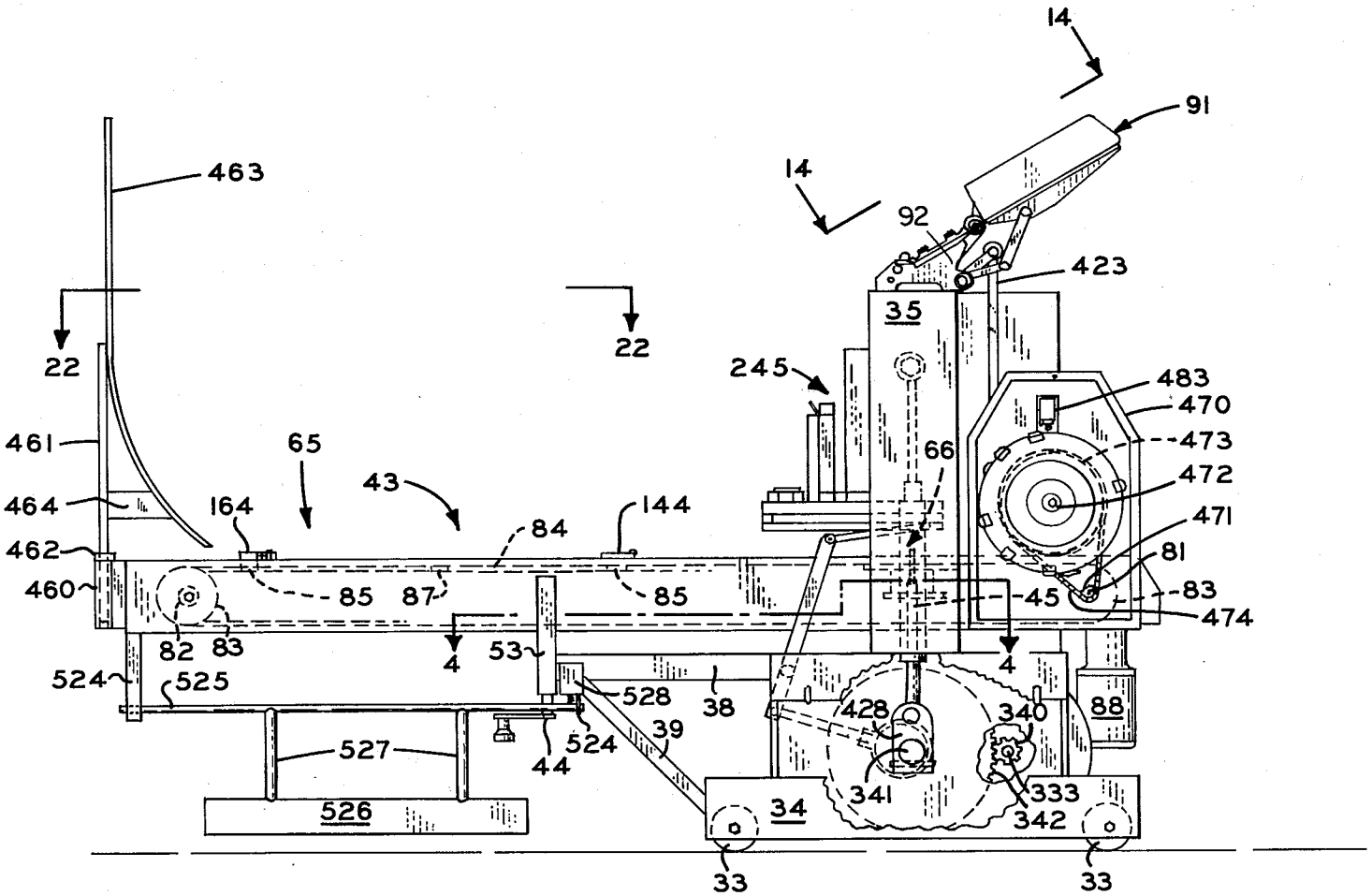
FIG. 3 is a side view of the machine, as viewed from line 3—3 in FIG. 2, with a portion of a housing of the machine broken away to reveal internal structure.

Referring in greater detail to the drawings, a truck 32 is preferably mounted on wheels 33 so that the machine may be trundled about at will. Opposite sides of the truck are substantially identical, each including a base 34 and upright extensions 35. As will become apparent, the base and the extensions also constitute a housing for certain portions of the machine located therein. The upper ends of the extensions 35 are rigidly interconnected by a tie bar 36 and the bases 34 rigidly interconnected by a pair of tie bars 37. As best seen in FIG. 3, a cantilever arm 38 is rigidly horizontally extended from the upper portion base 34 and a brace 39 provided between the lower portion of the base and the extended portion of the arm.

It will be evident that the bases 34, extensions 35, and tie bars 36 and 37 define a rectangular opening 42. A rectangular table 43 is extended through the opening 42 and supported in a substantially horizontal attitude for elevational adjustment by four screw jacks 44 and 45, as best shown in FIGS. 4 through 7. The four jacks are mounted in the truck 32 substantially at the corners of the rectangle. The rearward jacks 44 are of the form shown in FIGS. 6 and 7 and the forward jacks 45 of the form shown in FIG. 5. The jacks 44 are directly operable by means of cranks 46. However, by means soon to be described, a chain 47 interconnects the jacks for corresponding rotation to raise and to lower the table 43 in parallelism whenever either crank 46 is turned.

Referring to FIGS. 4, 6 and 7, a cross bar 52 is suspended by brackets 53 mounted on opposite sides of the table 43 and downwardly extended therefrom. To form the rearward jacks 44, screw threaded bores 54 are formed vertically through opposite ends of the cross bar. The extended ends of the arm 38 and the brace 39 at opposite sides of the truck 32 are interconnected by an angle iron brace 55. A bore 56 is formed through the brace in alignment with each of the screw threaded bores 54. A shaft 57 is a screw threadably engaged in each of the bores 54 and rotatably extended through the bore 56 thereabove. A crank handle 46 is provided on each of the shafts 57 for manual rotation thereof. A thrust washer 59 is rigidly mounted on each of the shafts 57 immediately below the brace 55. A combined thrust bearing the sprocket 60 is rigidly mounted on the upper end of each shaft 57 in rotatable engagement with the brace 55. It will be evident that the table 43 is thus supported by the jacks 44 on the shaft 57 supported by the thrust bearing and sprocket 60.

Figure 1:
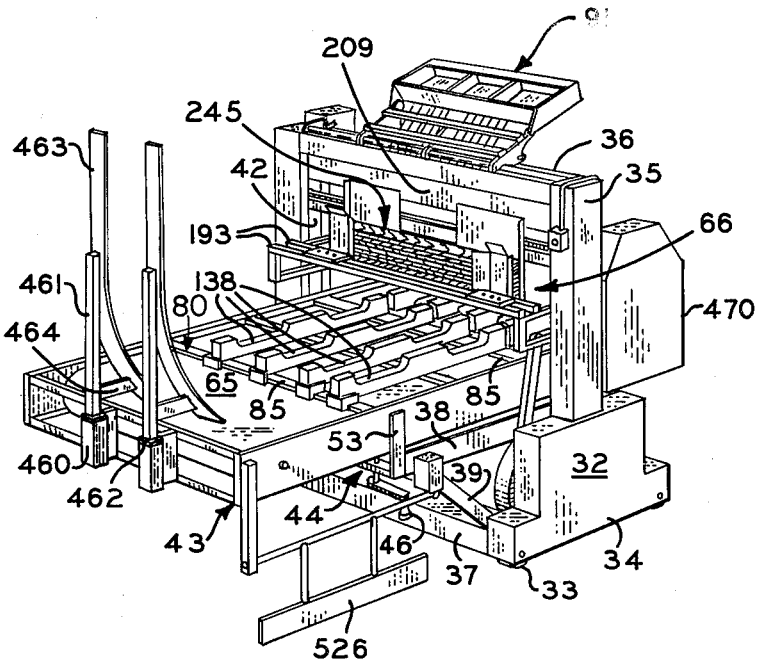
FIG. 1 is a perspective view of a machine embodying the principles of the present invention.

As evident in FIGS. 1 and 3, the table 43 has a receiving and inverting station 65 and a nailing station 66. Since the nailing station 66 of the table 43 and its support must resist vigorous and speedy hammering action, the jacks 45 must be strong enough to be durable when subjected to such stress. As shown in FIG. 5, a box beam 70 is extended transversely of the table 43 at the nailing station. A hardened plate 71 is provided in the truck 32 directly beneath the beam 70. At the position where the jack 45 is desired, the plate provides a journal socket 72. A screw threaded shaft 73 is journaled in each of the sockets and extended upwardly through the box beam 70. Mounted within the beam is a non-rotatable block 74 having a screw threaded bore 75 with which the shaft is screw threadably engaged. A combined thrust bearing and sprocket 76 is mounted on the lower end of the shaft 73 in rotatable engagement with the plate 71. The chain 47 is trained about the sprockets 76 and 60 so that whenever any of the crank handles 46 is turned, to turn the shafts 57, the shafts 73 are correspondingly rotated and the table 43 responsively raised or lowered while maintained in substantially horizontal position.

A conveyor 80 has a conveyor drive shaft 81 mounted transversely of the table 43 adjacent to the nailing station 66 and a conveyor idler shaft 82 mounted in the table adjacent to the receiving station 65. Sprockets 83 are mounted on the drive shaft 81 and idler shaft 82 on opposite sides of the table. Endless chains 84 circumscribe the sprockets at opposite sides of the table and each has an upper run above the table and a return lower run below the table. Flight bars 85, to which attention will subsequently be invited, interconnect the chains to form a conveyor. The flight bars are connected to the chains in adjustably spaced relation by means of cap screws 86, best seen in FIG. 22, screw threadably engaged in screw threaded sockets in the links of the chain. Auxiliary flight bars 87 are provided between the flight bars 85 for support purposes, soon to be described.

An angle head reversible motor 88 is mounted on the table 43 and has driving connection to the drive shaft 81.

Forwardly adjacent to one of the flight bars 85 is an arched flight bar 89 disposed to exert a rearwardly clamping force for purposes later to be described.

Figure 2:
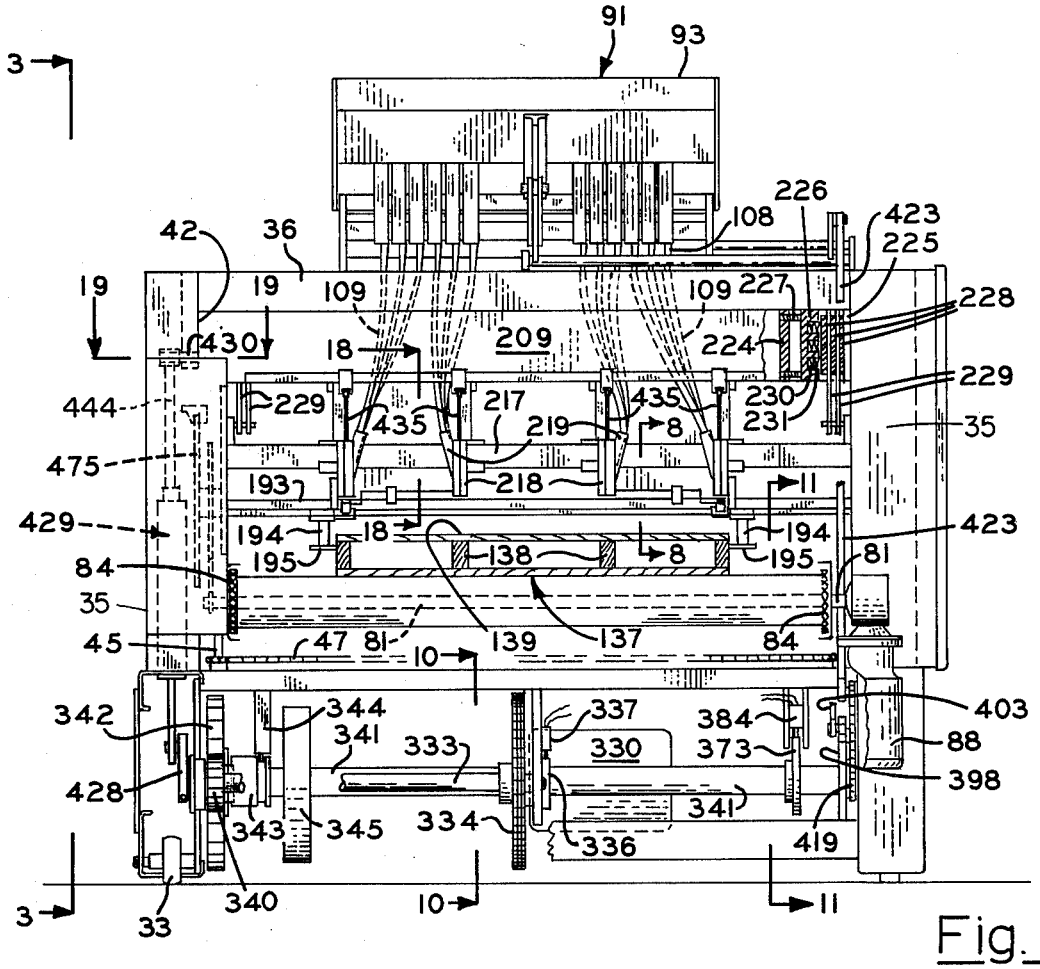
FIG. 2 is a rear elevation of the machine.
Figure 15:
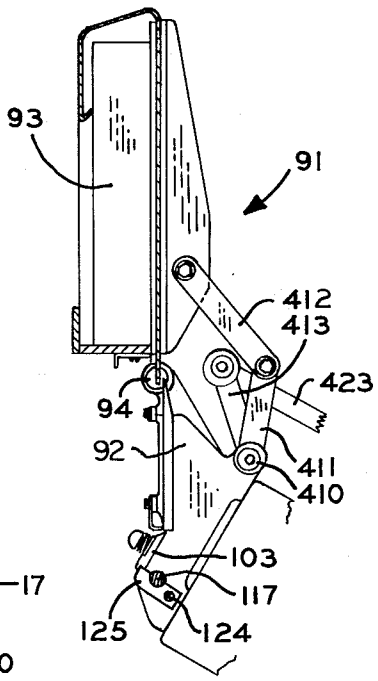
FIG. 15 is a vertical section taken on line 15—15 of FIG. 14.

Any suitable nail supply mechanism 91 is mounted on the tie bar 36 as shown in FIGS. 1, 2 and 3. As best seen in FIGS. 3 and 15, a base 92 is rigidly mounted on the tie bar 36. A hopper 93 is mounted for pivotal oscillating movement on the base 92 by means of pintles 94. The hopper has nail receiving slots 95. The base 92 has a pair of base plates 96 which are slightly overlapped by the hopper and provide slots 97 in registry with the slots 95. During operation, the hopper 93 is pivotally oscillated by a drive system subsequently to be described and shakes the nails 98 into the slots 95. As nails 98 fall into the slots 95 and are suspended therein by their heads, they gravitate along the slots and into the slots 97 in the plates 96.

Figure 14:
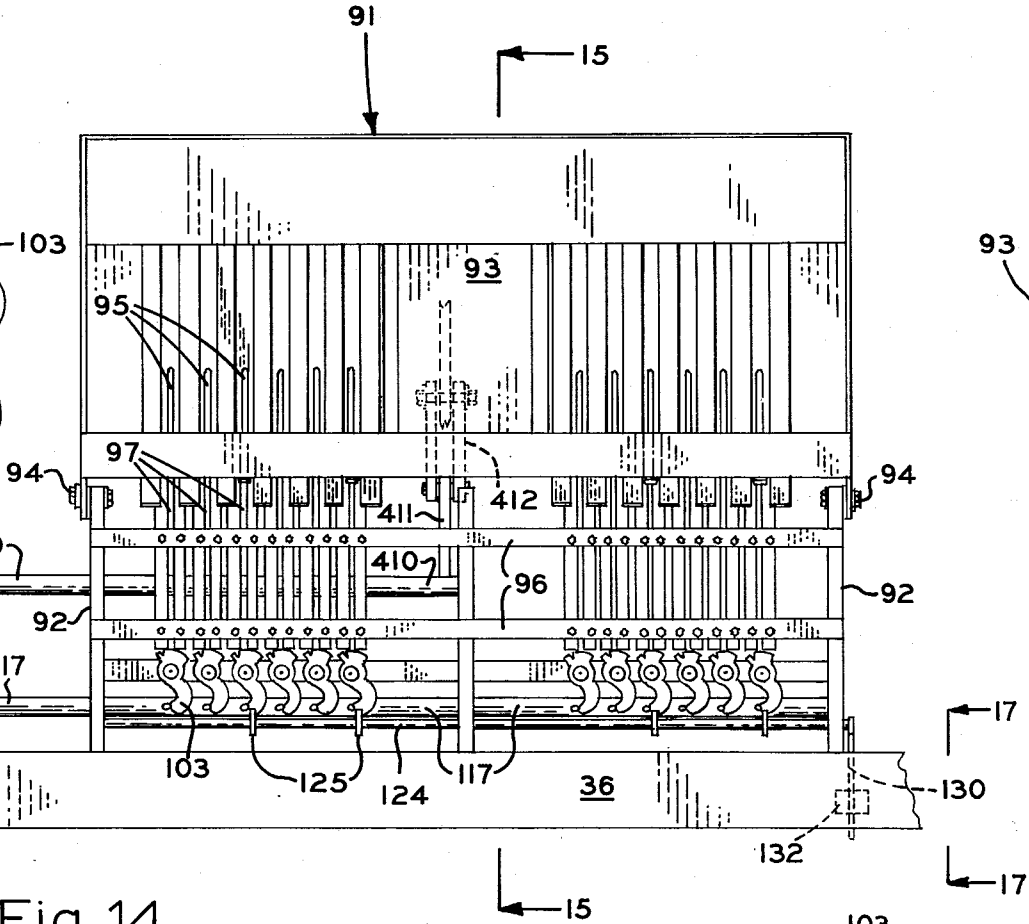
FIG. 14 is a front elevation of a nail magazine and feeding mechanism employed in the machine.
Figure 16:
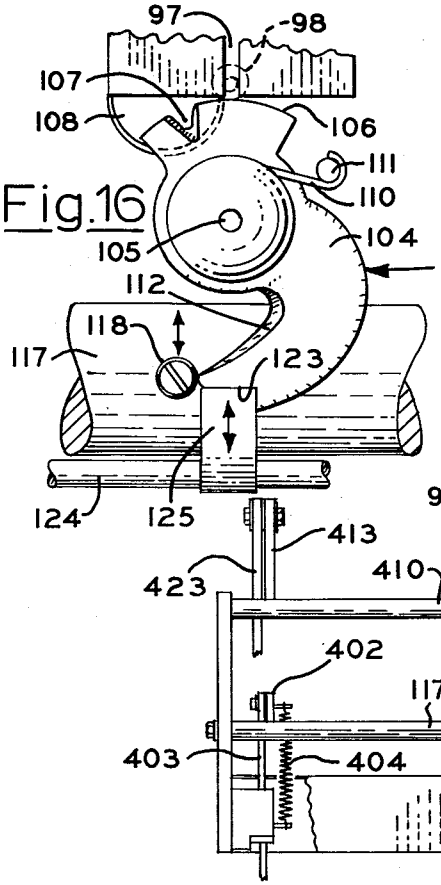
FIG. 16 is a substantially enlarged fragmentary portion of FIG. 15 showing a nail pick and associated structure.

As best shown in FIGS. 14 and 16, each of the slots 97 has a lower end provided with a nail pick 103. Each nail pick has a substantially circular body 104 rotatably mounted on a pin 105 attached to the base 92. Each pick has a concentric arcuate nail blocking portion 106 disposed to cover the lower end of its respective slot 97. A nail receiving notch 107 is provided in the locking portion and is movable by rotation of the finger to and from alignment with the slot 97. The notch is of such dimensions as to receive a single nail 98 at a time. Adjacent to each pick is a funnel 108, adapted to receive a nail, which communicates with a nail delivery hose 109. A helical spring 110 is anchored on the body 104 and on the base 92 at 111. The spring is prestressed to urge its pick in a clockwise direction, as viewed in FIG. 16. Each finger has a substantially helical cam 112 disposed in the direction of rotation of the pick as urged by the spring 110.

A nail pick operating shaft 117 is mounted in the nailing mechanism 91 in a substantially horizontal position in the base 92 and extends along adjacent to the row of nail picks 103. A rotatable cam follower 118 is mounted on the shaft 117 adjacent to each of the picks 103 so as to be engageable by the cam 112. To actuate the picks, the shaft 117 is rotated so as to cause the follower 118 to move upwardly, as viewed in FIG. 16. As the follower engages the cam 112, the spring 110 urges the pick in a clockwise direction. The relationship of the cam and the follower is such that as the roller moves upwardly, the pick is permitted to rotate in a clockwise direction until the notch 107registers with the end of its respective slots 97. In such position, a single nail 98 is admitted to the notch 107. The shaft 117 is then rotated in the opposite direction to cause the follower 118 to descend. As it descends in engagement with the cam 112, the pick is rotated in a counterclockwise direction so that the notch 107 passes into registration with the funnel 108 and drops its nail 98 therein.

It is sometimes desirable to render a nail pick 103 inoperable so that a fewer number of nails 98 are driven at a given time. To render certain of the nail picks inoperable, several or all thereof are provided with a notch 123. A lockout shaft 124 is rotatably mounted in the base 92 in parallel relation to the shaft 117 adjacent to the nail picks 103. The shaft 124 mounts stop fingers 125 which are received in the notches 123 when the shaft 124 is rotated in one direction to lock the selected picks 103 from operation, and which are retracted from the notches 123 to release the picks for operation by the followers 118 in the manner previously described.

Figure 17:
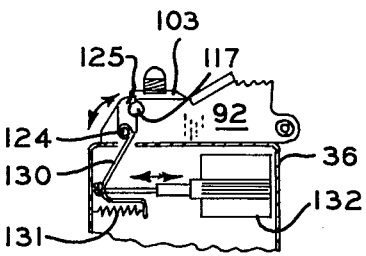
FIG. 17 is a fragmentary vertical section taken on line 17—17 in FIG. 14.

As best shown in FIG. 17 a lever 130 is extended from the lockout shaft 124. A tension spring 131 interconnects the lever 130 and the upward extension 35 of the truck 32. A solenoid 132 interconnects the lever and the tie bar 36 in opposition to the spring 131. Thus, when the solenoid is de-energized the spring rotates the shaft 124 in a clockwise direction to bring the fingers 125 into engagement with the notches 123 so that their respective nail picks 103 cannot operate. When the solenoid 132 is energized, the shaft 124 is rotated in a counterclockwise direction to remove the fingers 125 from the notches 123 so that the picks 103 can operate.

Figure 28:
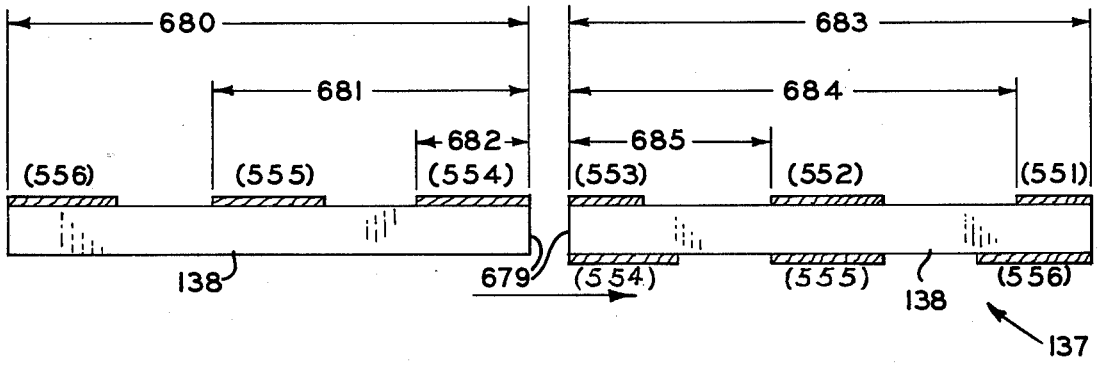
FIG. 28 is a schematic illustration of the operation of the machine of the present invention in fabricating a pallet showing the fabricating sequence.

As illustrated in FIGS. 1, 2 and 28, a pallet 137 normally consists of a plurality of stringers 138 having upper and lower surfaces interconnected by a plurality of transverse slats or deck boards 139. A full pallet 137 has slats nailed to both the upper and lower surfaces of the stringers 138. A "half-pallet" has the slats nailed to only one such surface.

Figure 22:
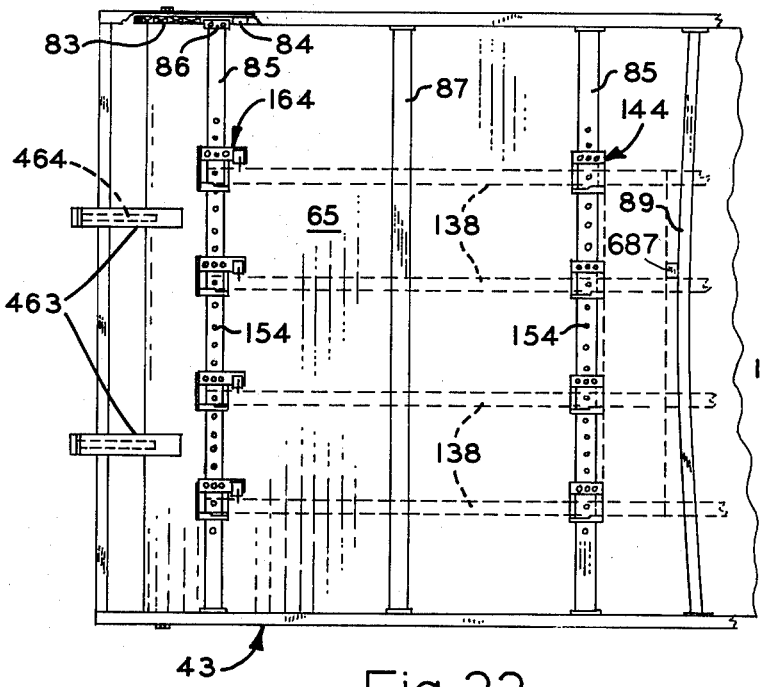
FIG. 22 is a fragmentary plan view of a conveyor employed in the machine of the present invention together with ramps which elevate partially completed pallets from the conveyor for inversion.
Figure 26:
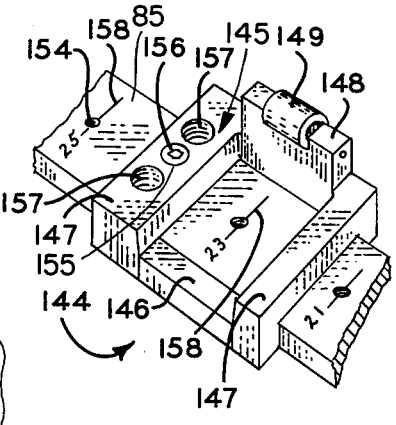
FIG. 26 is a fragmentary perspective of a leading chuck and flight bar on which it is mounted.

Referring to FIG. 22, one of the flight bars 85 has a plurality of leading chucks 144 secured thereto in spaced relation therealong. As shown in FIG. 26, each leading chuck consists of a substantially square box like body 145 fitted downwardly over the flight bar 85. The body has a floor 146, part of which is formed by the flight bar 85. The chuck has substantially parallel side walls 147 and a forward wall 148. The walls 147 and 148 define a socket having a rearwardly disposed opening and an upwardly disposed opening adapted to receive the forward end of a stringer 138. The forward wall 148 mounts a roller 149 for rotation about a substantially horizontal axis.

For reasons subsequently to become apparent, the flight bars 85 are of the same thickness as the slats 139 so that the floor 146 is spaced upwardly from the table 43 a distance equal to such thickness. Further, the body 145 is downwardly extended both fore and aft of the flight bar 85 so as to be slidably mounted thereon and so as to transmit forces imposed on the chuck 144 during operation directly to the flight bar and the table.

Since the stringers 138 vary in number and position for particular forms of pallets 137, each of the flight bars 85 provides a multiplicity of spaced screw threaded bores 154 spaced therealong. One of the walls 147 of each chuck 144 has a bore 155 which can be registered with any of the screw threaded bores 154. A screw threaded pin 156 is inserted through the bor 155 and screw threadably engaged in a selected bore 154 to lock the chuck in adjusted position. To facilitate proper positioning, an inspection bore 157 is formed through the side wall 147 on each side of the chuck bore 155 and calibrated lines 158 formed on the flight bars aligned with the screw threaded bores 154. Thus, the chuck 144 can be slid along the flight bar 85 until the lines 158 calibrated to provide the desired stringer spacing is evident through the inspection bores 157. The pin 156 is then tightened into position to lock the chuck in place.

Trailing chucks 164 are illustrated in FIGS. 22 through 25. Each trailing chuck consists of a body 165 fitted downwardly over a flight bar 85 both fore and aft thereof whereby the body is positioned on the flight bar for slidable movement longitudinally thereof. The body defines a forwardly and upwardly opening socket having a floor 166 partially formed by the flight bar 85. As before, the floor 166 is space upwardly from the table 43 a distance equal to the thickness of a slat 139. The body has a side wall 167 and a rear wall 168. A bracket 169 integral with the body 165 is extended forwardly from the rear wall 168 in parallel relation to the side wall 167. The bracket provides a channel 170 into which a block 171 is fitted and secured by a hold down screw 172. The block provides a channel 173 disposed in substantially parallel relation to the flight bar 85. The block 171 is longitudinally slotted at 174 on opposite sides of the channel 173. A carriage block 175 is positioned in the channel 173 for slidable movement longitudinally thereof. A circular cutting wheel or knife 176 is mounted for rotation on a spindle 177 mounted in the carriage block 175 and having opposite ends extended through the slots 174. A set screw 178 is screw threadably engaged in the carriage block and tightened against the spindle to hold it into position. A cylindrical guide 179 is rigidly mounted on the carriage block and extended longitudinally of the channel 173. The guide registers with a bore 180 into which it has guided engagement when the carriage block 175 is slid inwardly of the channel. A compression spring 181 is provided about the guide and urges the carriage block 175 and the cutting wheel 176 in the direction of the side wall 167 or, expressed differently, toward the socket formed by the body 165.

The bracket 169 provides a chuck bore 186 adapted to register with the screw threaded bores 154 in the flight bar 85. Inspection bores 187 are provided on opposite sides of the chuck bores through which visual reference can be made to the graduations 158. A screw threaded pin 188 is extended downwardly through the chuck bore 186 and screw threadably engaged in a selected bore 154 in the flight bar. The chuck bores 155 and 186, flight bar bores 154 and the graduations 158 are so positioned that the chucks 144 and 164 can be quickly and easily located to achieve the desired spacing of the stringers 138 with the forward ends thereof lodged in the leading chucks 144 and the rearward ends lodged in the trailing chucks 164.

Figure 8:
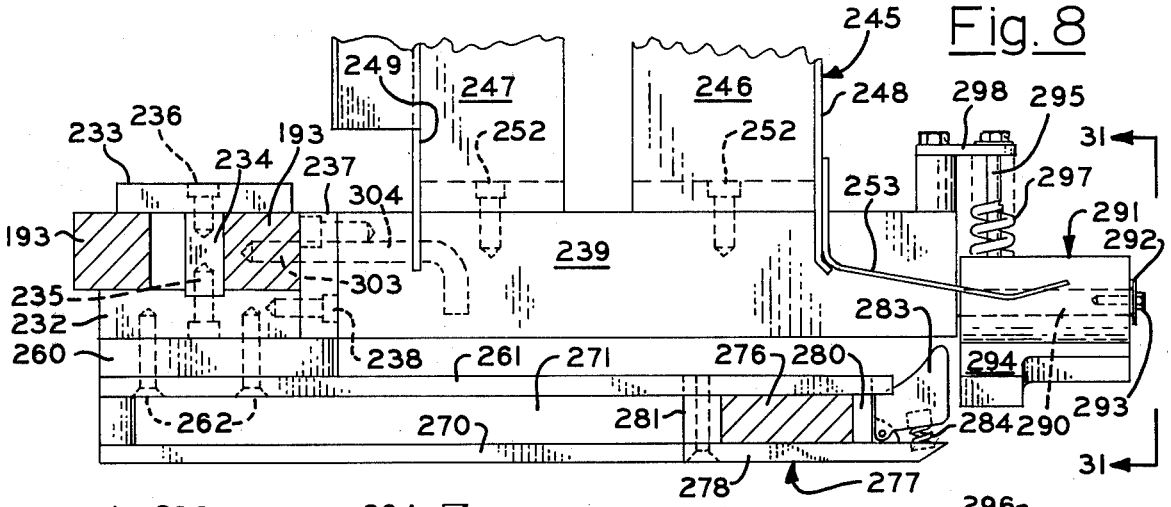
FIG. 8 is a fragmentary vertical section taken on line 8—8 of FIG. 2.
Figure 9:
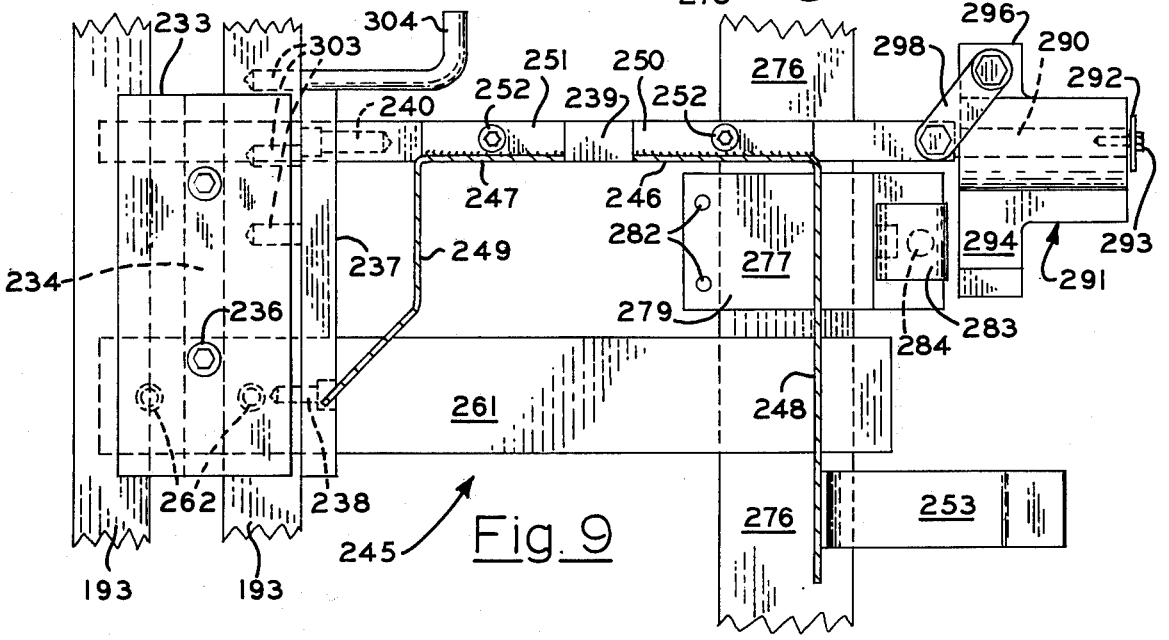
FIG. 9 is a plan view showing the structure shown in FIG. 8.

As best shown in FIGS. 2, 8 and 9, a pair of substantially parallel beams 193 are rigidly mounted between the extensions 35 in the truck 32. A pair of pedestals 194, shown only in FIG. 2, are mounted on the beams in adjustably spaced relation and downwardly extended therefrom. Stringer guiding wheels 195 are mounted on the downwardly extended pedestals in rolling engagement with opposite sides of a pallet 137 for reasons soon to be described.

As best seen in FIG. 19, each of the upward exensions 35 of the truck 32 is of box beam construction and has a longitudinal opening 200. A pair of elongated blocks 201 are mounted in each beam and in turn mount ways 202 having juxtapositioned brass wear plates 203 and inwardly facing brass wear plates 204 disposed toward the opposite extension. The wear plates 203 define a slide track therebetween.

An auxiliary frame 209 is mounted between the wear plates 203 at opposite sides of the truck 32 for vertical elevational movement. The auxiliary frame consists of a pair of panels 210 having slide plates 211 sandwiched therebetween and extended between the wear plates 203. Edges of the panels 210 slidably engage the wear plates 204. A shaft 212 extends through the slide plates 211 into the extensions 35 and is connected to a drive linkage subsequently to be described so as elevationally to reciprocate the auxiliary frame 209.

A sub-frame 217 is mounted between the wear plates 203 in spaced relation below the auxiliary frame 209 as best shown in FIG. 2. The sub-frame mounts erect nail chucks 218 having nail delivery tube 219 connected thereto to which respective hoses 109 leading from the nail funnels 108 are connected. The sub-frame has opposite ends mounted between the wear plates 203 for reciprocal elevational movement while maintaining a horizontal attitude in the same manner as the auxiliary frame.

At the end of the auxiliary frame 209, a vertical partition 224 is rigidly mounted between the panels 210 as shown in FIG. 2. Each partition 224 is mounted in spaced relation to an end of the auxiliary frame which is closed by an end plate 225. A follower 226 is mounted between the panels 210 for adjustment in spaced relation to the partition 224 by means of bolts 227 extended through the base plate and screw threadably engaged in the follower. Three friction plates 228 are positioned between the end plate 225 and the follower 226. A pair of arms 229 are connected to each end of the sub-frame 217 and upwardly extended between the friction plates 228. The follower 226 has a plurality of sockets 230 formed therein disposed toward the friction plates 228. Compression springs 231 are located in the sockets and bear against the friction plate.

As best shown in FIGS. 8 and 9, a pair of bottom plates 232 are fitted upwardly against the pair of beams 193 and cap plates 233 rested downwardly thereon. A slide block 234 is fitted between the plates 232 and 233. Each of the bottom plates is secured to its respective slide block by a pair of cap screws 235 extended therethrough and screw threadably engaged in the slide block. Similarly, each cap plate 233 is secured to its respective slide block by a pair of cap screws 236 extended downwardly therethrough and screw threadably engaged in the slide block. It will be evident that by loosening either the upper or lower cap screws, the bottom plates and cap plates can be adjustably positioned longitudinally of the beams 193.

A base plate 237 is rigidly secured to each of the bottom plates 232 by cap screws 238 and upwardly extended therefrom in facing engagement with the forwardmost of the beams 193. A support bar 239 is rigidly mounted, as by cap screws 240, on the outermost end of each of the base plates 237 and forwardly extended therefrom with the support bars disposed in parallel relation.

A slat magazine 245 is mounted on the support bars 239 and upwardly extended therefrom. Each side of the magazine provides a forward side wall 246 and a rearward side wall 247. A forward wall 248 is inwardly extended from the forward side wall 246 and a rearward wall 249 inwardly extended from the rearward side wall 247. The forward side wall is welded to a mounting block 250 and the rearward side wall similarly welded to a mounting block 251. The mounting blocks are fastened downwardly on top of the support bar 239 by means of cap screws 252. For reasons soon to be described a hold down leaf spring 253 is fastened to the forward wall 248 and extended downwardly and forwardly therefrom. The forward wall and the rearward wall 249 are preferably extended downwardly over the upper edge of the support bar 239.

A spacer 260 is positioned upwardly against each of the bottom plates 232 and a slat support 261 secured upwardly thereagainst, as by means of cap screws 262 extended upwardly therethrough and screw threadably engaged in the bottom plate. The slat support extends forwardly to a position just beyond the slat magazine 245. Outwardly of the slat supports 261 but in downwardly spaced parallel relation thereto are mounted a pair of feeder bar slides 270, as shown in FIG. 13. The slides are mounted in the truck extensions 35 in any suitable manner and, as best shown in FIGS. 8 and 13, with the slat supports define a slideway 271. An elongated slide bar 272 has opposite ends slidably engaged in the slideways 271 and rested on one of the slides 270. The slide bar has a downwardly extended ear 273 to which reference will subsequently be made. An elongated feed bar 276 is mounted on the slide bar 272. A pair of box like carriages 277 are mounted in circumscribing relation on the feeder bar 276 outwardly of each of the slat supports 261 but inwardly of the slides 270. Each of the carriages has a bottom plate 278 which is forwardly extended from the carriage, a top plate 279, a forward spacer 280 and a rearward spacer 281. Cap screws 282 interconnect the bottom plate 278 and top plate 279 through the rearward spacer 281 and can be tightened to secure the carriages in selected spaced positions on the feeder bar 276. A pawl 283 is mounted on the bottom plate 278 of each carriage 277 and forwardly extended therefrom for pivotal movement to an operating position extended above the slat support 261 and a retracted position substantially flush with said slat support. A compression spring 284 urges the pawl upwardly.

Figure 31:
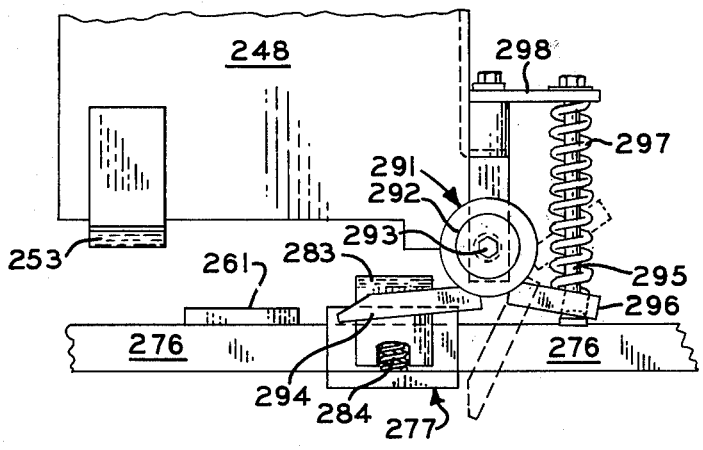
FIG. 31 is a fragmentary section taken on line 31-31 of FIG. 9.

As best shown in FIGS. 8, 9 and 31, a journal 290 is forwardly extended from each of the support bars 239. A flushing device 291 is mounted on each of the journals and secured thereon as by means of a washer 292 and cap screw 293. The device provides a flat finger or shelf 294 extended from the journal 290 in the plane of the slat support 261. A stop 295 limits upward movement of the finger to said plane of the support while accommodating downward pivotal movement. A spring seat 296 is oppositely extended from the finger 294 and a spring 297 located under compression between the seat 296 and a bracket 298 mounted on the support bar 239.

To adjust the slat magazine 245 to slats 139 of different lengths, the cap screws 236 are loosened, the cap plates 233, slide blocks 234 and bottom plates 232 slid along the beams 193 to desired position and the cap screws tightened. To facilitate such adjustment, a number of forwardly disposed sockets 303 are provided in the forwardmost beam 193 spaced in accordance with standard slat lengths. When an adjustment is to be made, rods 304 are placed in selected sockets, the support bars 239 slid thereagainst and said cap screws tightened.

To adjust the forward and rearward walls 248 and 249 to slats of different widths, the cap screws 252 are released, the blocks 250 and 251 repositioned and the cap screws tightened down into screw threaded sockets, not shown, provided for the purpose.

To adjust the spacing of the pawls 283 as desired, the cap screws 282 are released, the carriages 277 slid into desired position on the feeder bar 276 and the cap screws retightened.

As shown in FIGS. 2 and 10, to drive the machine in the sequence to be described, a motor 330 is mounted by any suitable means in the lower portion of the truck 32. The motor has a drive shaft 331 which in turn mounts a small drive sprocket 332. A countershaft 333, best shown in FIGS. 2, 3 and 10 is mounted in the truck 32 in parallel relation to the drive shaft 331. The countershaft 333 mounts a large sprocket 334 in the plane of the motor sprocket 332 and a chain 335 circumscribing the sprockets 332 and 334 provides driving interconnection therebetween. As shown in FIG. 2, a cam 336 is mounted on the main drive shaft 341 and operates a switch 337. As will subsequently become apparent, the switch operates to initiate a reversing of the conveyor formed by the chains 84 and flight bars 85.

At the side of the truck 32, a pinion gear 340 is mounted on the countershaft 333. A main drive shaft 341 is mounted in the truck in parallel relation to the countershaft but extends between the opposite sides of the truck. The maindrive shaft 341 mounts a main drive gear 342 for free rotation thereon in mesh with the pinion gear 340. During normal operation, the motor 330 operates continuously to drive the sprocket 332, the sprocket 334, the countershaft 333, the pinion gear 340 and the main drive gear 342. The main drive shaft 341, however, operates only as desired. A clutch 343 having an operating solenoid 344 interconnects the main drive shaft 341 and the main drive gear 342. Driving interconnection between the main drive gear 342 and the main drive shaft 341 is effected only when the clutch 343 is actuated. A solenoid 344 has controlling connection to the clutch. To insure prompt stopping action, a constant drag brake 345 is provided on the main drive shaft.

As seen in FIG. 11, to reciprocate the slat feeder bar 276 from the main drive shaft 341, a rock shaft 370 is mounted transversely in the truck 32. A rocker arm 371 is mounted on the rock shaft 370 at each side of the truck. As shown in FIG. 11, a pitman 372 interconnects the upper end of each rocker arm and the ear 273 on the adjacent edge of the slide bar 272. The rocker arm is downwardly extended from the rock shaft 370. An eccentric 373 is mounted on the main drive shaft 341 and connected to the lower end of the rocker arm 371 by a link 374. As best shown in FIG. 12, the link 374 constitutes a fail safe mechanism which consists of a rod 375 telescopically extended into a tube 376. An opening 377 is formed through the tube 376 in registry with a socket 378 formed in the rod 375. A spherical detent 379 is rested in the opening 377 and the socket 378. A cylinder 380 is mounted on the tube 376 in circumscribing relation to the opening 377 and radially extended from the tube. A follower 381 is mounted for reciprocal movement in the cylinder 380 toward and from the detent 379 and is urged toward the detent by a compression spring 382. The follower axially projects from the cylinder and an arm 383 is transversely extended from the follower. A microswitch 384 connected electrically in series with the main drive motor 330, is mounted on the tube 376 adjacent to the cylinder 380. The switch is held in closed condition whenever the detent 379 is rested in the opening 377 and socket 378. If a jam occurs in the slat magazine 245, the thrust of the rod 375 in the tube 376 forces the detent 379 upwardly from the opening 377 and socket 378 to cause the follower 381 to raise and lift the arm 383 from the microswitch 384 permitting the switch to open and thus interrupt operation of the motor 330.

To rock the nail pick operating shaft 117, a cam 398 is mounted on the main drive shaft 341, an arm 399 is pivotally mounted at 400 above the cam and has a cam follower 401 thereon rested on the cam. As shown in FIG. 14, an arm 402 is radially extended from the shaft 117 and a push-pull link 403 pivotally interconnects the cam follower arm 399 and the nail pick operating arm 402. A tension spring 404 interconnects the arm 402 and the tie bar 36 so as to urge the follower 401 into continuous engagement with the cam 398.

As previously described, the hopper 93 is mounted for pivotal oscillation on pintles 94. As shown in FIGS. 14 and 15, an operating shaft 410 is rotatably mounted in the base 92 and extends from one side of the base to approximately a mid point. An arm 411 is radially extended from the shaft 410 and has an extended end pivotally connected to the hopper 93 by a second arm 412. A rocker arm 413 is radially extended from the shaft 410. As shown in FIG. 11, beneath the rocker arm 413, a stub shaft 418 is mounted in the truck 32 in parallel relation to the main drive shaft 341. A sprocket 419 is mounted on the stub shaft and has driven connection to a sprocket 420 on the drive shaft by means of an endless chain 421. A crank pin 422 is mounted on the sprocket 419 and a push-pull 423 pivotally interconnects the rocker arm 413 and the crank pin 422. It will be evident that as the main drive shaft 341 rotates the stub shaft 418, the push-pull link 423 through the arms 411 and 413, which constitute a bell crank, oscillates the hopper 93 through the arm 412.

It will be recalled that the auxiliary frame 209 is mounted in the truck 32 for reciprocal elevational movement and has driving connection elevationally to reciprocate the sub-frame 217 through the friction plates 228 and arms 229. As shown in FIGS. 2 and 3, to drive the auxiliary frame and thus the sub-frame, a crank 428 is connected to the main drive shaft 341. An over-travel link 429 is connected to the crank 428 and to the auxiliary frame 209 at 430. Thus, as the main drive shaft 341 is rotated, the auxiliary frame 209 is elevationally reciprocated.

Figure 20:
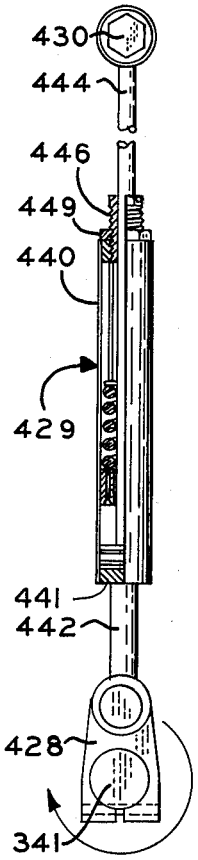
FIG. 20 is a side elevation, partially in vertical sections, of an over-travel mechanism utilized in the machine.
Figure 21:
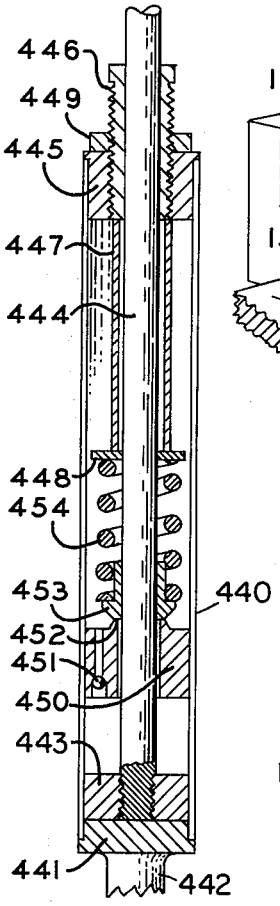
FIG. 21 is an enlarged axial section of a portion of the over-travel mechanism of FIG. 20.
Figure 23:
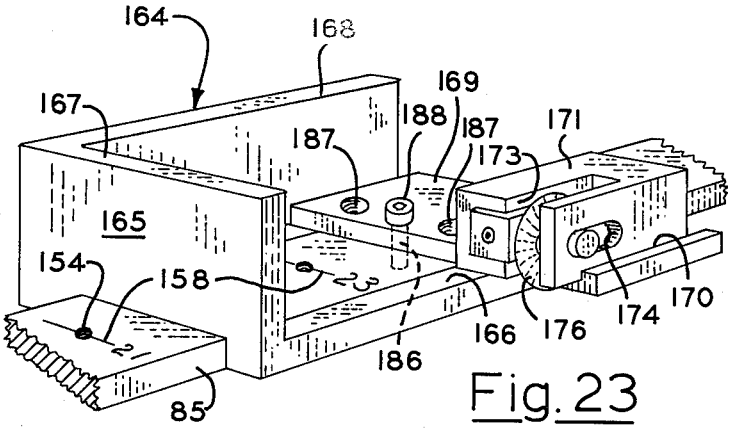
FIG. 23 is a fragmentary perspective of a following rail chuck and flight bar on which it is mounted.
Figure 25:
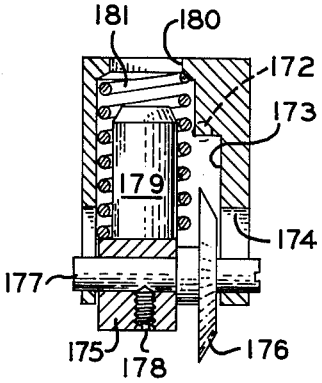
FIG. 25 is a section taken on line 25—25 in FIG. 24.
Figure 24:
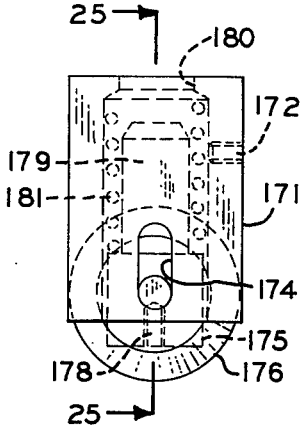
FIG. 24 is a fragmentary somewhat enlarged side view of a portion of a structure shown in FIG. 23.

As evident in FIG. 2, the erect nail chucks 218 are positioned on the sub-frame 217 so that when the sub-frame is lowered, the nail guides strike the upper surface of the slat 139 positioned therebelow on the stringers 138. While four chucks are shown in FIG. 2, in actual practice, each chuck represents a row of three chucks positioned so as to locate their respective nails 98 at the desired nailing position on a slat. Each nail chuck 218, has a nail punch or hammer 435 mounted on the auxiliary frame 209 to drive the nails held by their respective chucks 218 in the slats 139 and stringers 138. It is desirable to have the nails driven into the pallet being formed with sufficient force to bury the heads of the nails a sixteenth of an inch or so. It is obviously undesirable to drive the nails in too deeply. The over-travel link 429 is best shown in FIGS. 20 and 21. The over-travel link provides an oil filled cylinder 440 having a closed end 441 connected to the crank 428 by a rod 442. A piston 443 is slidably fitted to the cylinder and has a connecting rod 444 connected to the auxiliary frame 209 at 430. The upper end of the cylinder 440 is closed by a bushing 445 having a screw threaded opening therein. A combined packing gland and pressure adjustment nut 446 is screw threadably engaged in the bushing about the connecting rod 444 and has an inward extension 447 providing a seat 448 in circumscribing relation to the connecting rod. A jamb nut 449 is mounted on the nut 446 to lock the same in position by tightening downwardly against the bushing 445. A partition 450 is welded or otherwise secured in the cylinder 440 in spaced relation to the closed end 441. The partition has a check valve 451 to permit the rapid passage of oil downwardly through the partition. However, the partition is relatively loosely fitted to the connecting rod 444 to in effect provide an annular passage through the partition along the rod. The partition has an upwardly disposed valve seat 452 circumscribing the connecting rod 444. A valve body 453 is slidably mounted on the connecting rod. A compression spring 454 is mounted between the seat 448 and the valve body 453 to urge the body into sealing engagement with the seat 452.

As the main drive shaft 341 is rotated to elevate the over-travel link 429, the piston 443 engages the closed lower end 441 and the upward thrust on the rod 442 is directly communicated to the connecting rod 444 to lift the auxiliary frame 209. Continued rotation of the main drive shaft 341 permits the over-travel link 429 and thus the auxiliary frame 209 to move downwardly. Initially, the sub-frame 217 and its nail chucks 218 move downwardly with the auxiliary frame. When the nail chucks strike a slat 139, further downward movement of the chuck and sub-frame is precluded. The friction plates 228 traveling downwardly with the auxiliary frame 209 slide downwardly on the arms 229. As the auxiliary frame 209 continues its downward movement, the nail punches 435 strike the heads of the nails and drive them into the slat and the stringers 138 therebelow. The nail driving pressure is controlled by the spring 454 as it is adjustably compressed by the nut 446. Of course, this pressure can be regulated by loosening the jamb nut 449, screwing the nut 446 inwardly or outwardly of the cylinder 440, and returning the jamb nut to position. When the resistance of the nails to driving action by the punches 435 is sufficient, oil in the cylinder 440 below the partition 450 passes upwardly along the connecting rod 444, unseats the valve body 453 against the resistance of the spring 454 permitting the piston 443 to move toward the partition. As the crank 428 continues to turn, the compressive forces exerted on the over-travel mechanism 429 open the check valve 451 permitting the oil to pass therethrough so that the piston 443 can be brought into direct engagement with the closed end 441 for the positive upward movement of the link 429.

Returning to FIGS. 1 and 3, a pair of upright sockets 460 are mounted on the receiving end of the table 43. Vertical standards 461 are removably fitted to the sockets 460 and provide stops 462 that keep the standard from sliding downwardly in the sockets. A ramp 463 is mounted on each of the standards and held in rigid position by a brace 464. Each ramp has a lower end disposed adjacent to the top of the table 43 at an elevation such that the flight bars 85 and 87 can pass thereunder but lower than the upper surfaces of the stringers 138 when supported in the chucks 144 and 164. From the lower ends, the ramps curve rearwardly and upwardly to substantially vertical upper ends for purposes that will subsequently be described.

Figure 27:
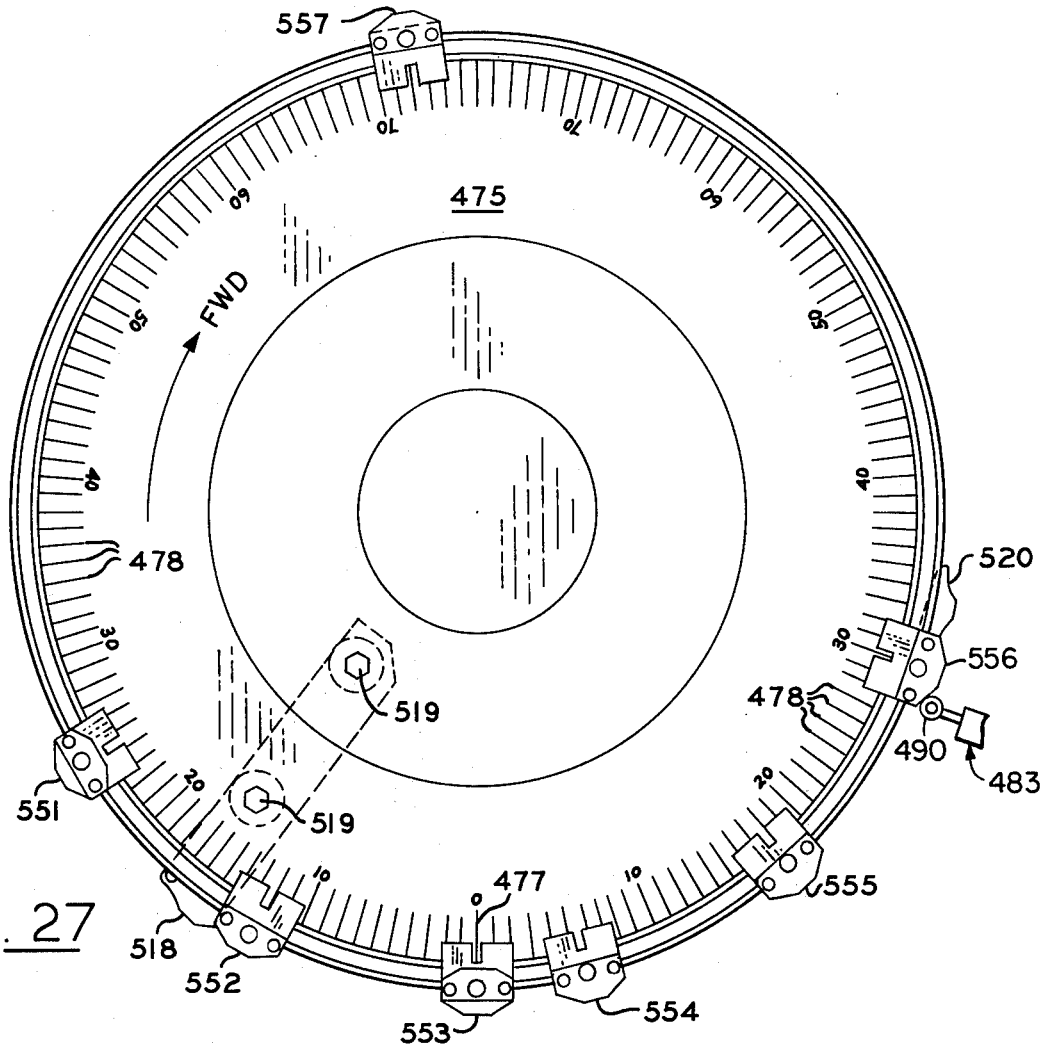
FIG. 27 is an axial elevation of a program disc utilized in the control system of the present invention.
Figure 29:
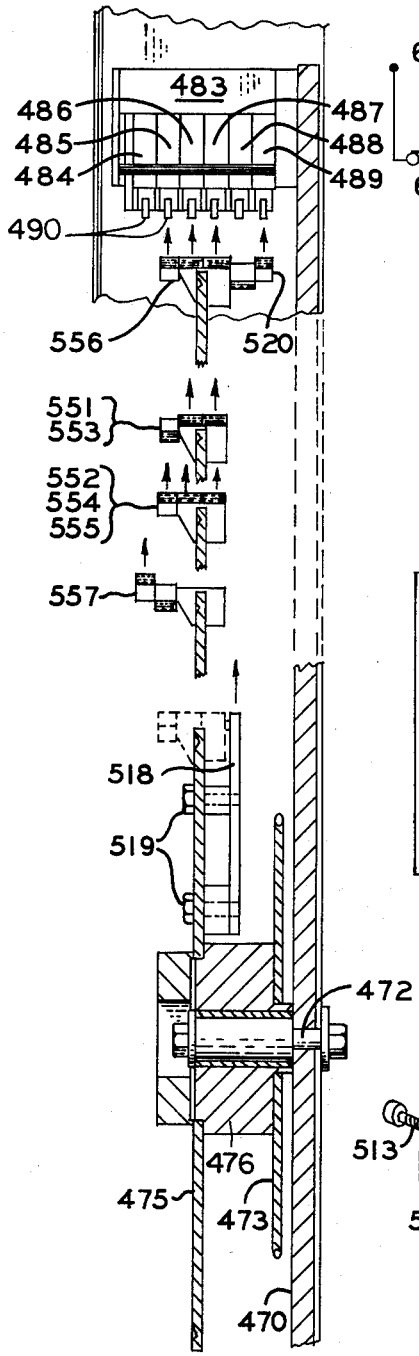
FIG. 29 is a schematic illustration of the program disc and associated switches utilized in the machine.

As evident in FIG. 3, a control housing 470 is mounted on the table 43 adjacent to the conveyor drive shaft 81. A sprocket 471 is mounted on the drive shaft. A stub shaft 472 is mounted in the housing in parallel relation to the drive shaft 81. A large sprocket 473 is mounted on the stub shaft in the plane of the small sprocket 471 and driving interconnection established therebetween by means of a circumscribing endless chain 474. A program disc 475, best shown in FIGS. 3, 27 and 29, is mounted on the stub shaft 472 with a spacer 476 between the disc and the large sprocket 473. The disc and large sprocket are rigidly interconnected for corresponding rotation. It will be apparent that the rotation of the disc is proportional to the distance of travel of the upper run of the chains 84. The periphery of the disc is provided with a zero or starting point 477 with graduations 478 oppositely extended therefrom about the periphery of the disc and calibrated in terms of inches of travel of the chains 84 or flight bars 85.

A switch box 483 is mounted in the housing 470 adjacent to the upper periphery of the disc 475. Microswitches 484 through 489 are mounted in the box and each presents an operating roller 490 adjacent to the disc.

Figure 30:
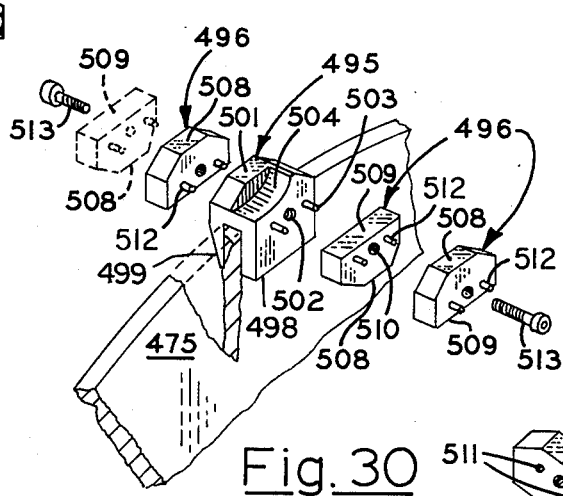
FIG. 30 is a fragmentary view of the program disc with switch operating cams utilized thereon shown in exploded relation.
Figure 33:
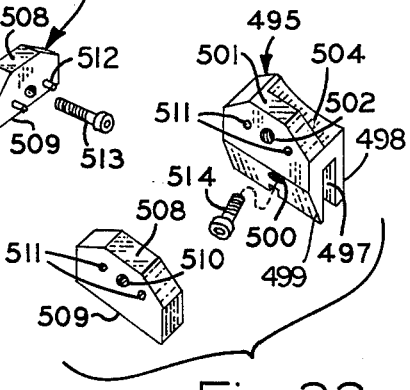
FIG. 33 is a perspective view of a base cam and auxiliary cam in exploded relation to show the sides thereof opposite to those seen in FIG. 30.

As best shown in FIGS. 29, 30, and 33 in order selectively to actuate the switches 484 through 489, base cams 495 and auxiliary cams 496 are provided. Each base cam has a channel 497 having an arcuate bottom fitted to the periphery of the disc 475. The base cam has a leg 498 extended down the rear side of the disc and a front leg 499 extended down the front of the disc. The front leg is downwardly tapered and a screw threaded bore 500 extended inwardly through the front leg for engagement with the disc at approximately 60° angle to the plane of the disc. Each base cam has an outer camming surface 501 which successively has an inclined ramp portion, an outer dwell concentric to the disc 475, and an inwardly sloped portion. A screw threaded bore 502 is formed centrally through the base cam normal to the plane of the disc. On equal distances on opposite sides of the bore 502, parallel studs 503 are outwardly extended therefrom. The base cams are preferably wide enough to control both switches 486 and 487. Since it is desired to have switch 487 closed in following relation to switch 486, the cam surface in the path of switch 487 is provided with a delaying concavity 504.

As shown in FIG. 30, each of the auxiliary cams 496 has a camming surface 508 which is identical to the caming surface 501 of the base cam except there is no concavity. It also has an opposite edge 509 which does not engage any of the switches 484 through 489. Each auxiliary cam has a bore 510 which precisely registers with the bore 502 when the camming surface 508 is positioned in conforming relation with the camming surface 501. On one side of each of the auxiliary cams 496, a pair of bores 511 are provided to receive the studs 503 with the bore 510 aligned with the bore 502. On the opposite side, each auxiliary cam provides a pair of studs 512 in precise alignment with the bores 511. It will be seen that any desired number of auxiliary cams can be mounted on each side of the base cams 495 and the auxiliary cams may serve as non-operating spacers when their edges 509 are outwardly disposed and as switch operating cams when their camming surfaces 508 are outwardly disposed. To hold any such desired number of auxiliary cams on a base cam, a bolt 513 is extended through the bores 510 and screw threaded into the bore 502.

To mount the base cams 495 on the disc 475, its channel 497 is fitted downwardly over the periphery of the disc in the precise position desired and a cap screw 514 screw threaded into the bore 500 and tightened against the disc.

For purposes soon to be described, a loading stop 518 is mounted on the disc 475, as by bolts 519, and a reversing stop 520 rigidly mounted on one of the auxiliary cams 496 and extended counterclockwise therefrom, as seen in FIG. 27. The loading stop 518 has a path of travel adapted to open switch 488 and stop 520 has a path of travel adapted to actuate switch 489.

Referring to FIG. 3, a pair of brackets 524 are mounted on the table 43 adjacent to the receiving station 65. A rod 525 is journaled horizontally in the brackets beneath the table and a foot control board 526 mounted on the rod by means of a pair of arms 527. A main control switch 528 is mounted on the table and has controlled connection to the rod.

Figure 32:
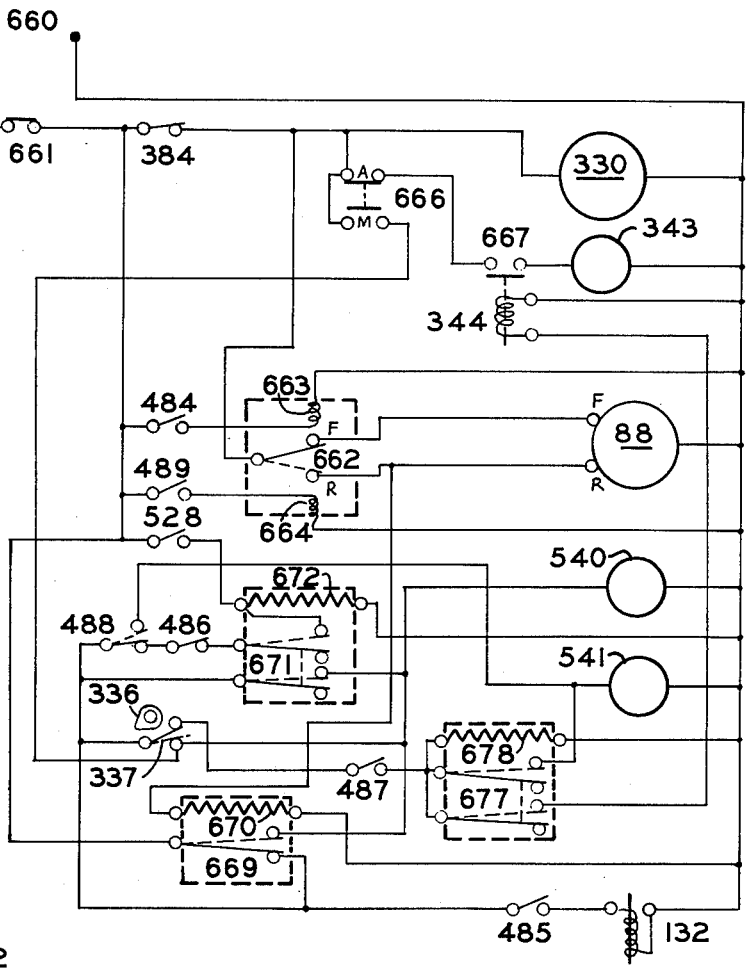
FIG. 32 is a schematic wiring diagram of the drive and control systems of the present invention.

It is to be understood that the reversible conveyor motor 88 has an electrically operable conveyor clutch 540 and conveyor brake 541 shown schematically in FIG. 32.

Referring to FIGS. 29 and 32, switch 484 is a reverse-stop switch which is normally open but when engaged by a cam 496 to close disengages the conveyor clutch 540, applies the conveyor brake 541, and reverses the conveyor motor 88, all as will subsequently be apparent.

Switch 485 is a nail selection switch which is normally open but closed when contacted by nail pick cam 556 to energize the solenoid 132 to release the restrained nail picks 103. It is opened when engaged by a cam 496 to de-energize the solenoid and permit the spring 131 to bring the stop fingers 125 into engagement with selected nail picks 103 to lock them against operation, as shown in FIG. 14.

Switch 486 is a conveyor clutch switch. It is normally closed but opened by engagement with cam 495 to disengage the conveyor clutch 540. Switch 487 is a conveyor brake switch which is normally open but when closed by the cam 495 applies the conveyor brake 541.

Switch 488 is a two position loading stop switch which disengages the conveyor clutch 540 and applies the conveyor brake 541 when the upper run of the conveyor reaches a loading position subsequently described. When in the full line position shown in FIG. 32, the loading stop switch is in series with the conveyor clutch switch 486 and performs substantially the same function as switches 486 and 487. When switch 488 is moved to its dashed line position by the loading stop 518, it disengages the conveyor clutch 540 and applies the conveyor brake 541. Switch 489 is a normally open switch which when it is closed reverses the motor 88. The reversing switch 489 is closed by the reversing cam 520.

In FIGS. 27 and 29, characteristic cam assemblies are shown at 551 through 557. As best shown in FIGS. 29 and 30, cam assembly 556 employs a base cam 495 with auxiliary cams 496 arranged to engage switches 485, 486, 487 and 489 during rotation of disc 475. The cam assemblies 551 and 553 engage switches 486 and 487 respectively. The cam assemblies 552, 554, and 555 engage nail switch 485, clutch switch 486 and brake switch 487 respectively. The cam assembly 557 is selected and arranged to engage reverse stop switch 484. If it is desired to drive three nails at a nailing operation instead of two, the cam assembly for that operation is assembled so as to actuate switch 485 during disc rotation. This energizes the solenoid 132, overcomes the spring 131, and retracts the fingers 125 from the notches 123 so their respective nail picks 103 can operate. In other words, the third nail pick 103 of each set of nail picks is made operative by energizing the solenoid 132. When solenoid 132 is deactivated, shaft 124 is rotated by spring 131 through crank 130, causing finger 125 to engage its notch 123 preventing pick 103 from rotating when cam 118 is moved out of position.

In FIG. 32 a source of electrical energy is indicated at 660. The nail driving motor 330 is connected to the source 660 in series with the fail safe switch 384 and the start/stop switch 661. Of course, the fail safe switch opens only in an emergency. The conveyor drive motor 88 is connected to the source in series with the fail safe switch 384 and the start/stop switch 661 and one side of a double throw, reversing switch 662. The other side of the switch 662 is connected to the motor 88 for reversing purposes. The reversing switch 662 has a holding coil 663 which is connected electrically in series with the normally open reverse stop switch 484 and the start/stop switch 661. When the coil 663 is energized it holds the reversing relay 662 in a position causing the motor 88 to run forwardly. A rearward holding coil 664 of the reversing relay 662 is connected electrically in series with the reverse starting switch 489 and the start/stop switch 661. When the coil 664 is energized, it causes the reversing relay 662 to be held in a position reversing the motor 88. Switch 662 is a solenoid operated two position switch which remains in whatever position it is placed until forceably moved to its other position. When either of its two solenoids 663 or 664 is energized, the switch closes to such solenoid's respective contact where it remains until the opposite solenoid is energized whereupon it closes to the other contact.

When the switch 489 is momentarily closed by the reversing cam 520, the contact of the switch 662 is drawn to its "R" position and remains there even when switch 489 is allowed to re-open. This reverses the motor 88. Simultaneously coil 670 is energized moving the contact of relay 669 to its opposite contact. This de-activates the circuit through the loading stop switch 488, the conveyor clutch switch 486 and holding relay 671 allowing coil 672 to become de-energized. Also the circuit through switch 337 is interrupted rendering brake switch 487, relay 677 and coil 678 inoperative during the reversing mode. During this condition the cams engage the switches but the switches are inoperative. It will be noted that the coil 670 has just been energized moving the relay 669 to its dashed line position shown in FIG. 32. Thus, current is directed through clutch 540 energizing it for the reversing procedure. The reversing procedure continues until the reversing stop cam assembly 557 momentarily contacts reverse stop switch 484 moving switch 662 to its forward mode of operation thus breaking the circuit through reversing switch 662, coil 670, and the clutch 540.

Under such circumstances, the conveyor drive shaft 81 is coasting rearwardly since the clutch 540 has been disengaged by the opening of the relay 669 but the conveyor motor 88 is operating in the forward direction having been so directed by the reverse stop cam assembly 557. A braking action is applied to the conveyor drive shaft 81 when the switch 337 is opened by cam 336 causing the clutch 540 momentarily to engage the conveyor motor which is now operating in the forward mode. Opening of the switch 337 de-activates the circuit to the nailing clutch so that no nailing occurs.

With the conveyor at a standstill in the fully reversed position and the conveyor motor 88 running forwardly, the described sequence of operation is re-initiated by closing the foot switch 528.

An automatic-manual switch 666 is provided which when in automatic condition connects the nail motor clutch 343 in series with a switch 667 controlled by the solenoid 344 in series with the fail safe switch 384 and the start/stop switch 661. A disabling relay 669 is connected to the source 660 through the start/stop switch 661. The disabling relay is normally engaged with a pole which is connected electrically in series with the nail switch 485, the nail pick solenoid 132, and the conveyor clutch switch 486 and subsequent circuitry. The disabling relay has an opposite pole to which it is closed whenever a coil 670 thereof is energized. Such coil is connected to the reversing side of the reversing relay 662. Thus, when the reversing relay 662 reverses, the coil 670 of the disabling relay 669 is energized closing the relay to the pole which is connected in series with the conveyor drive clutch 540. A holding relay 671 has an actuating coil 672 in series with the foot switch 528. The holding relay 671 has a pair of switching elements, both of which are open when the coil 672 is de-energized and both of which close when the coil is energized by actuation of the foot switch 528. One of the switching elements is connected in series with the normally closed contact of the disabling relay 669 and with the conveyor drive clutch 540. The other switching element of the holding relay 671 is connected electrically in series with the normally closed contact of the disabling relay 669, the loading stop switch 488, the conveyor clutch switch 486 and with the holding coil 672 and to the source of electrical energy 660. The loading stop switch 488 is a double throw switch which when not in series with the conveyor clutch switch 486 directs current through the conveyor drive brake 541.

A double throw switch 337 is disposed for actuation by the cam 336, as shown in FIG. 2. The switch 337 is connected to the contact of the diabling relay 669 which is normally closed and the switch 337 has a contact to which it is normally closed in series with the conveyor brake switch 487 and a contact to which it is closed only by cam operation which is connected in series to the conveyor drive clutch 540. The contact connected to the conveyor drive clutch is also connected to the manual side of the automatic-manual switch 666.

A double relay 677 is connected to the conveyor brake switch 487 and is energized momentarily whenever switch 487 is closed. The relay 677 has a holding coil 678 connected to the source of electrical energy 660 and a pair of switching elements which are open, as shown in full line, whenever the coil is de-energized. One of the switching elements, closed by energizing the coil 678, is connected electrically in series with the solenoid 344. The second switching element of the relay 677, also closed when the coil is energized, is connected in series with the conveyor drive brake 541.

OPERATION

The operation of the machine of the present invention for nailing slats 139 on stringers 138 is believed to be clearly apparent and is briefly summarized at this point. The machine is preconditioned for operation by adjusting it to the type and dimensions of the pallet 137 to be made. For example, the number of aligned chucks 144 and 164 is selected to provide the number of stringers 138 the ultimate pallet is to have. Such chucks are then positioned in spaced relation on the flight bars 85 with due reference to the indicia 158 and secured in adjusted position by means of the screw threaded pins 156 and 188 tightened into selected bores 154. The flight bars 85 are positioned in parallel spaced relation on the chains 84 so that the chucks 144 and 164 are spaced to receive the opposite ends of stringers in their respective sockets. As will be apparent, there are successive pairs of flight bars 85 having aligned chucks 144 and 164.

The main cams 495 with their associated auxiliary cams 496 are secured in the proper positions on the program disc 475 successively to deliver the portions of the stringers 138 to the nailing station 66 so as to nail the slats 139 on the stringers 138 in the proper positions. Further, the auxiliary cams 496 are selected and positioned so as to actuate their respective switches 484 through 489 or to pass such switches without actuation by inversion of such cams. For example, the auxiliary cams 496 aligned with the nail switch 485 are positioned so as to deliver either three nails to the nailing chucks 218 at the intersection of the slats and stringers, by switch closing, or two nails by having the switch open. For illustrative convenience, in FIG. 27 the cam assemblies are numerically designated. In FIG. 28, the nailing positions on the pallets being formed are parenthetically given the same element identifying numerals as the cam assemblies controlling the nailing at such positions. As described and illustrated, cam assembly 551 delivers two nails to position (551) shown in FIG. 28. Similarly, cam assembly 552 delivers three nails to position (552), cam assembly 553 delivers two nails to position (553), cam assembly 554 delivers three nails to position (554), cam assembly 555 delivers three nails to position (555)

and cam assembly 556 delivers three nails to position (556).

By reference to the graduations 478, which are calibrated in inches of conveyor travel to and from the nailing station 66, the cams 495 and auxiliary cams 496 can be precisely and quickly positioned. As can best be seen in FIG. 28, the half pallet shown at the left consists of the stringers 138 having the bottom slats 139 nailed to what temporarily is the top of the inverted stringers 138. The half pallet is then inverted and the top slats nailed thereto to complete the pallet, as shown at the right of FIG. 28. The leading end of the half pallet becomes the trailing end of the inverted pallet. Such end is referred to as the reference end 679. The base cams 495 and auxiliary cams 496 are positioned so that the outermost edges of the slats disposed at positions (554) and (556) are spaced to coincide with opposite ends of the stringers 138, a distance represented at 680. The slat shown at position (555) is spaced from the reference end 679 a distance shown at 681 equal to one-half of the length of the stringers 138 plus one-half of the width of the slat at the position (555). The trailing edge of the slat shown at position (554) is spaced from the reference end the width of said slat, as shown at 682. When the inverted slat shown at the left of FIG. 28 is turned over to its normally upright position, the cams and auxiliary cams are set so that the outer edges of the slats shown at positions (551) and (553) are spaced a distance equal to the length of a stringer 138 as shown at 683. The trailing edge of the slat at (551) is spaced from the reference end a distance equal to the length of a stringer 138 less the width of slat 139 at the position (551), as shown at 684. The trailing edge of the slat at position (552) is spaced from the reference end one-half the length of a stringer minus one-half of the slat on a position (552) as shown at 685.

As best shown in FIGS. 8 and 9, the magazine 245 is adjusted to accommodate the dimensions of the slats to be employed. The cap screws 252 are disengaged and the walls 248 and 249 are spaced to conform to the width of the slats. The cap screws 252 are then tightened into position to hold the walls in adjustment.

Sockets 303 are selected properly to space the support bars 239 and thus the flushing devices 291. The cap screws 236 are loosened and the support bars 239 slid outwardly until the base plates 237 strike rods 304 inserted into the selected sockets 303 achieving the desired spacing. The cap screws 236 are then secured to hold the support bars 239 in associated structure and adjustment.

The cap screws 262 are released and the carriages 277 slid inwardly or outwardly on the feeder bar 276 to position the pawls 283, as desired. The cap screws 282 are then tightened to hold the pawls in position.

The jacks 44 and 45 are adjusted by turning one of the cranks 46 and the table 43 raised or lowered so that the sub-frame 217 at its lower limit of travel brings the nail chucks 218 into engagement with the slats 139 and when the nail punches 435 are driven downwardly they drive the nails 98 into the slats and stringers 138 so as to be slightly countersunk.

After the adjustments have been made, the conveyor drive motor 88 and the nailing motor 330 are energized by closing the start/stop switch 661. The switch 666 is placed on "manual" so that the program disc 475 can be rotated and the conveyor correspondingly positioned to bring the reverse stop cam assembly 557 to the zero position 477 with the conveyor at the receiving station 65. In this condition, the auxiliary cam of cam assembly 557 closes the reverse stop switch 484 and energizes the coil 663 of the latching relay 662 which directs the electrical current to the forward operating mode of the conveyor drive motor 88.

An attendant then places the stringers 138 in the longitudinally aligned and opposing chucks 144 and 164. The stringers rest in the sockets of the chucks and on the auxiliary flight bar 87 spaced upwardly from the table 43 a distance equal to the thickness of a slat 139. It will be noted that the stringers are thus supported at each position at which the subsequent nailing operation is to be performed.

The switch 666 is then placed on automatic and the foot switch 528 closed. This engages the conveyor clutch 540 which engagement is maintained by the holding coil 672. The conveyor then moves forwardly until the leading end of the stringers 138 reach the nailing station 66. It will be observed that when the foot switch 528 is released, coil 672 remains energized through relay 669, stop switch 488 is, in normal position, clutch switch 486 also is in normal position, and the upper bridging element of relay 671 is closed, the latter having been closed when the foot switch 528 was closed. Even though foot switch 528 opens, the current through the coil 672 is maintained until interrupted by either opening of the clutch switch 486, the movement of the loading stop switch 488 to its alternate position, or the energizing of the coil 670 of the disabling relay 669 when the reversing coil 664 is energized by closing the reverse starting switch 489 placing the switch 662 in the reversing mode.

As the conveyor moves, the program disc 475 is rotated clockwise, as seen in FIG. 27, until the cam surface 501 of a base cam 495 shown in FIG. 30 opens the switch 486 to disengage the clutch 540 and after a brief coast, the notch or concavity 504 closes the switch 487 to apply the conveyor brake 541. At the same time, current is applied through the relay 677 to the solenoid 344 to close the switch 667 and actuate the nail driving clutch 343. Through the mechanism shown in FIG. 11, the eccentric 373 rocks the rocker arm 371 so that the pitman 372 causes the feeder bar 276 in its retracted position to move forwardly so that the pawl 283 picks off the lowermost slat in the slat magazine 245 and carries it to a position over the nailing station 66 while held down by the springs 253 as shown in FIGS. 8, 9 and 31. It should be noted that as the slats are carried forwardly by the pawls 283 they are rested on the slat supports 261 somewhat above the stringers 138. The slat being moved to position passes on to the fingers or shelves 294 of the flushing devices 291. As the auxiliary frame 209 moves downwardly, the engagement of the nail chucks 218 with the slat supported on the fingers 294 presses such slats downwardly against the urging of the springs 297 until the slat rests in desired position on the stringers 138. As the flushing devices are forced to pivot on the journals 290, the fingers pivot downwardly with the slat descending therebetween and the fingers engaged with the ends of the slat position said ends flush with the outside surfaces of the stringers.

Through the described drive linkage shown in FIG. 3 and elsewhere, the crank 428 causes the over-travel link 429 to draw the auxiliary frame 209 downwardly until the nail chucks 218 mounted on the sub-frame 217 strike the slat 139 disposed on the stringers 138 in the nailing station 66. The slidable engagement of the friction plates 228 with the arms 229 permits the auxiliary frame 209 to continue its downward movement after the sub-frame is stopped by engagement of the nail chucks 218 with the slat. Such continued downward movement causes the nail punches 435 to drive their respective nails 98 into the slats and stringers.

It will be evident that if any jamming of the slat occurs, the fail safe mechanism 374 will operate to open switch 384 with the consequent de-energizing of the nailing motor 330 and the conveyor motor 88.

At the bottom of the nailing stroke, the clutch switch 486 is held open and the brake switch 487 held closed by the position of the program disc 475. At that point, the cam 336 on the main drive shaft 341, as shown in FIG. 2, closes switch 337 momentarily overriding the switches 486 and 487 resulting in the conveyor clutch 540 being actuated and the brake 541 being released. A brief moment after the cam 336 actuates the switch 337, the conveyor clutch switch 486 is closed and the conveyor clutch 540 engaged and the conveyor brake switch 487 is opened breaking the circuit to the nailing clutch solenoid 344. The nailing clutch remains mechanically engaged however until it is mechanically disengaged at the top of the nailing stroke of the auxiliary frame 209. It should be noted that before the auxiliary frame 209 reaches the upper limit of its travel under the acutation of the main drive shaft 341, the sub-frame 217 strikes a stop, not shown, on the extensions 35, so that the auxiliary frame travels upwardly from the sub-frame 217 sliding the friction plates 228 upwardly along the arms 229 to precondition the nailing mechanism for repeat operation. Whenever it is desired to use three nails at each nailing position, an auxiliary cam 496 is positioned to contact the switch 485 to energize the solenoid 132 and thus retract the lockout fingers 125. When the solenoid is not energized, the spring 131 shown in FIG. 17, rotates the shaft 124 to bring the lockout fingers 125 into the position shown in FIG. 16 limiting the nail delivery to two.

Having nailed the first slat at the position (554) in FIG. 28 to the stringers 138, the conveyor continues to advance the stringers until the position (555) is disposed in the nailing station 66. As before, the clutch 540 is disengaged and after a momentary coast, the conveyor brake 541 is applied. The pawls 283 deliver the next slat to the fingers 294 of the flushing device 291. As the sub-frame 217 is lowered to bring the nail chucks 218 into engagement with the slat, the slat is forced downwardly pivoting the fingers 294 downwardly so as to bring the ends of the slat into positions flush with the sides of the stringers 138.

The described procedure is continued until slats are nailed at the positions (555) and (556). Thus, what is referred to as a "half pallet" has been formed. When the loading stop switch 488 is engaged by the loading stop 518, the loading stop switch 488 overrides the conveyor clutch switch 486 to disengage the conveyor clutch and the loading stop switch 488 is bypassed to apply the conveyor brake 541 without energizing the nailing clutch solenoid 344.

After the half pallet has been formed, the reversing cam 520 comes into position and closes the reverse starting switch 489 which energizes the latching or reversing relay 662 to change the mode of operation of the conveyor motor 88 to reverse. The conveyor clutch 540 remains engaged because the disabling relay 669 is energized through the reverse circuit of the latching relay 662. The disabling relay 669 is closed only when the reversed circuit of the conveyor motor is energized. Of course, the conveyor brake 541 is released. When the reverse starting switch 489 has closed to energize the reverse coil 664 of the reversing relay 662, the disabling relay 669 disables the nailing switch 485, the clutch switch 486, the brake switch 487, and the loading stop switch 488. However, the disabling relay 669 keeps the conveyor clutch 540 energized when the other circuits are disabled.

During the forwardmost travel of the conveyor, the flight bar 85 mounting the leading chucks 144 passes downwardly about the drive sprocket 83. Thus momentarily, the chucks 144 are not positioned to shove the half pallet back toward the receiving and inverting position 65. However, the blades 176, shown in FIGS. 23, 24, and 25 engage the stringers and pull them back toward station 65.

The conveyor reverses until the reverse stop cam of assembly 557 closes the reverse stop switch 484. This energizes the forward coil 663 of the relay 662 to place the motor 88 in its forward mode of operation. At the same time, the reverse stop switch 484 actuates the disabling relay 669 which interrupts the holding circuit and returns the nailing switch 485, clutch switch 486, brake switch 487, and loading stop switch 488 to operative condition.

As the conveyor returns the half pallet to the receiving and inverting station 65, the lower ends of the ramps 463 shown in FIGS. 1, 2 and 22 extend under the slat 139 nailed onto the stringers 138 at the position (556) so designated in FIG. 28 that the pallet is pulled upwardly from the chucks 164 incident to its rearward travel. The half pallet is then manually inverted and positioned on the table 43 forwardly of the forwardmost chucks with the stringers 138 aligned with the chucks 144 and 164.

With the half pallet inverted, the forward edge of the rearwardmost slat nailed in the position (556) of FIG. 28 is manually thrust against the resilient flight bar 89, shown in FIG. 22 and with the aid of the rollers 149 on the leading chucks 144, the half pallet is laid flatly on the table 43 with the nailed slats rested directly on the table and the slot at (556) wedged between the resilient flight bar 89 and the rollers 149. The clamped engagement of the forward slat between the resilient flight bar 89 and the rollers 149 secures the half pallet for movement with the conveyor.

Referring to FIGS. 27, 29 and 32 the sequential operation of the structure and circuits shown and described can be readily summarized. Assuming that the slat magazine 245 has been loaded with slats 139, the start stop/-switch 661 is manually closed and the automatic-manual switch 666 placed on "Manual".

To load the stringers 138 in the chucks 144 and 164, the switch 666 is manipulated to rotate the disk 475 until the cam assembly 518 engages and closes the loading stop switch 488. The stringers 138 are then manually loaded in the chucks. The "Manual" switch 666 is then actuated to rotate the disk in a clockwise direction, as viewed in FIG. 27, until the cam assembly 554 is adjacent to and next to reach the switch station represented by the roller 490 in FIG. 27. It will be appreciated that the switches 484 through 489 are in alignment and that only the roller 490 of the reverse-stop switch 484 can be seen, the others being aligned behind it, as viewed. Thus, as seen in FIG. 27, the roller 490 designates the station or position at which all of said switches are located.

The automatic-manual switch 666 is then placed on "Automatic" and the foot switch 528 closed. The disk 475 then rotates in a clockwise direction, as viewed, until the cam assembly 554 reaches the switching station represented at 490 in FIG. 27 at which point the cam assembly 554 opens the clutch switch 486, closes the brake switch 487 and closes the nail switch 485 releasing the clutch 540, stopping the conveyor 80 by means of the brake 541, and actuating the solenoid 132 to retract the fingers 125 and condition the apparatus to deliver and nail three nails 98 at a time. In the meantime the bottom slat 139 has been pushed forwardly by the pawls 283 so that it is held in position by the flushing device 291 spaced above the position on the stringer 138 at which it is to be nailed. The nailing clutch 343 is simultaneously actuated through the solenoid 344 to cause the auxiliary frame 209 to descend and the nail punches 435 to force the slat down into position and to continue their downward strokes to drive the nails 98 into place securing the slat to the stringers.

Continued rotation of the motor 330 raises the frame 209 and retracts the nail punches 435. Cam 336 then actuates switch 337 to interrupt current to coil 678 allowing relay 677 to return to the normal position shown in FIG. 32. This deenergizes solenoid 344 to disengage the nailing clutch 343, releases the brake 541 and engages the clutch 540 to resume driving of the conveyor 80.

When the cam assembly 555 reaches the switching station represented at 490 in FIG. 27, the cam assembly opens the clutch switch 486, closes the brake switch 487 and closes the nail switch 485 releasing the clutch 540, stopping the conveyor by means of the brake 541, lowering and nailing the second slat 139, all as described for cam assembly 554. As before, continued rotation of the motor 330 raises the frame 209, retracts the nail punches 435. The cam 336 actuates the switch 337 to interrupt current to the coil 678 allowing the relay 677 to return to normal position as a consequence of which the nailing clutch 343 is disengaged, the brake 541 released, and the clutch 540 engaged to resume driving the conveyor.

As the disk 475 continues its clockwise rotation, as viewed in FIG. 27, cam assembly 556 is brought to the switch station represented by roller 490. As evident in FIG. 29, the cam assembly 556 opens the clutch switch 486, closes the brake switch 487, and closes the nail switch 485 with the same consequences described for such identical operation of these switches by previous cam assemblies 554 and 555. At this point, the third slat 139 is nailed to the stringers 138 and a half pallet has been formed. However, when the clutch 540 has been momentarily re-engaged to drive the conveyor 80, the reversing cam 520 engages reverse starting switch 489. As previously descibed in connection with FIG. 32, the closing of the reversing switch 489 energizes coil 664, reversing switch 662 reversing the motor 88, reversing the direction of the rotation of the disk 475, and reversing the direction of travel of the conveyor 80. Such reversed operation continues while cam assemblies 556 through 551 are reversely traveled past the switch station represented at 490 in FIG. 27 until the reverse stop switch 484 is closed by the cam assembly 557 reaching the switch station. As the cam assemblies 556 through 551 are reversely traveled past their respective switches they remain unaffected. When the reverse starting switch 489 is closed to reverse the motor 88, the coil 670 is energized moving relay 669 to its upper position, as shown. This de-activates the circuits through stop switch 488, clutch switched 486 and holding relay 671, allows coil 672 to become de-energized and interrupts the circuit through the nail switch 485 to the solenoid 132. Also the circuit through switch 337 is interrupted rendering switches 487, 677 and 678 inoperative during reversing operation. Thus, during reverse operation, the cam assemblies pass their respective switches 485 through 488 without effect on them.

As shown in FIG. 29, the cam assembly 557 controls only switch 484 which when closed energizes coil 663 to reverse the switch 662 and return the motor 88 to its forward mode of operation.

Before the cam assembly 557 reaches the switch station, the half pallet which has been formed is carried to the left, as viewed in FIG. 3, on the conveyor 80 until its third slat 139 travels up the ramp 463 and is disconnected from the chucks 164, is manually inverted and replaced on the conveyor 80 flatly on the table 43 forwardly of the forwardmost chucks 144 with the stringers 138 aligned with the chucks 144 and 164. If desired, a positioning finger 687 is provided on the flight bar 89 and upwardly extended therefrom at a position to receive a stringer 138 thereagainst when properly aligned with the chucks 144 and 164 rearwardly thereof, as shown in FIG. 22. As previously described, the rearward slat is clamped between the resiliently arched flight bar 89 and the rollers 149 of the leading chucks 144. This places the half pallet almost its full length ahead of its previous position. At such time the conveyor 80 is at a standstill in its fully reversed position with the conveyor motor 88 running in its forward direction.

The foot switch 528 is then closed causing the holding relay 671 to actuate the clutch 540 to drive the conveyor 80 in its forward direction and the disk 475 in the clockwise direction, as viewed in FIG. 27. When the cam assembly 551 reaches the switch station it opens the clutch switch 486 and actuates the brake switch to stop the conveyor 80 and the disk 475. The nailing clutch 343 is simultaneously actuated through the solenoid 344 to cause the auxiliary frame 209 to descend and the nail punches 435 to force the slat 139 down into position and to continue their downward strokes to drive the nails into place. Since the slat 139 being nailed at (551) is a narrow slat only two nails are needed and the switch 485 is not closed and the fingers 125 remain in lock-out position.

Continued rotation of the motor 330 retracts the frame 209 and the nail punches 435. Cam 336 then actuates the switch 337 to interrupt current to coil 678 allowing the relay 677 to return to the normal position shown in FIG. 32. This deenergizes solenoid 344 to disengage the nailing clutch 343, releases the brake 541 and engages the clutch to resume driving the conveyor 80.

When the loading stop 518 reaches the switch station, it engages loading stop switch 488 and moves it to its dashed line position in FIG. 32. This actuates the conveyor brake 541, interrupts current through the switch 486 and coil 672 causing the holding relay to release the clutch 540, stopping the conveyor 80. At this point a new set of stringers 138 is positioned in the chucks 144 and 164. After the new stringers are in position, the foot switch 528 is closed and operation is resumed, as before.

Since the slat 139 to be nailed at (552) is a wide slat, three nails are desired. Thus, cam assembly 552 is configured, as shown in FIG. 29, to operate nail solenoid switch 485, clutch switch 486 and brake switch 487. When the cam assembly 552 actuates these switches, the conveyor 80 is stopped, the slat 139 positioned and nailed and the conveyor restarted as described for cam assemblies 556, 555 and 554.

Since the slat 139 to be nailed at (553) is a narrow slat, only two nails are desired. Thus, cam assembly 553 is configured to actuate the clutch switch 486 and the brake switch 487 but not the nail switch 485. The cam assembly 553 operates in the same manner as that described for cam assembly 551. At this point a pallet 137 has been completed, as shown at the right FIG. 28.

The foot switch 528 is then actuated to resume operation. The completed pallet 137 is discharged out the forward end of the machine, to the right as viewed in FIG. 3, as the new set of stringers 138 are advanced in increments of stepped progression into the nailing station 66 and the slats 139 nailed at the upwardly disposed positions (554), (555), and (556) as previously described. This then completes the second half pallet, the conveyor is reversed to carry the half pallet to the ramps 463 for inversion of the half pallet and continued operation.

In some instances, it is desired to produce half pallets without nailing the slats 139 on the tops of the stringers 138. When this is the case, the ramps 463 are simply removed from the machine by lifting the standards 461 from the sockets 460 and permitting the machine to discharge the half pallets at the rearward end of the conveyor rather than inverting them for subsequent nailing operations.

The nailing machine of the present invention automatically and synchronously delivers stringers 138 and slats 139 to a predetermined nailing station 66 where the properly associated stringers 138 and slats 139 are nailed in their desired association. Said machine minimizes the manual labor required in fabricating pallets and the like and thus minimizes their cost. The machine is quickly, easily and accurately adjustable to accommodate component stringers and slats of different sizes and different arrangements. The machine requires less floor space than known machines for the purpose; functions more dependably, economically and speedily; and is fully effective in accomplishing its intended purposes.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A machine for nailing slats on stringers comprising:

A. means for advancing a plurality of elongated stringers in substantially parallel spaced relation longitudinally in corresponding increments of stepped progression into a nailing station whereby predetermined slat receiving positions on the stringers are successively located in the nailing station;

B. a hopper adapted to hold slats in horizontal stacked relation adjacent to the nailing station and above the stringers with the lowermost slat disposed in a substantially horizontal plane;

C. a pusher mounted for reciprocal movement in said plane successively to slide the lowermost slats from said stack edgewardly horizontally to a ready position over the slat receiving positions of the stringers in the nailing station:

D. a shelf at each end of said ready position adapted to receive opposite end portions of the slats thereon, said shelves being pivotally mounted for movement between substantially horizontal positions and positions downwardly thereof;

E. resilient means urging the shelves into their substantially horizontal positions but permitting the shelves to pivot downwardly to deposit the slats on the stringers when the resilient means is overcome;

F. means for operating the pusher synchronously with the increments of stepped progression of the advancing means to deliver such slats to the receiving positions on the stringers as said positions reach the nailing station; and G. means operable synchronously with advancement of the stringers to force the slats individually successively downwardly in opposition to the resilient means whereby as the shelves tip downwardly they position the slats in their receiving positions transversely on the stringers and to nail the slats to the slat receiving positions on the stringers in interconnecting relation to the stringers while the slats are positioned thereon in the nailing station.

2. The machine of claim 1 in which the advancing means is reversible and comprises flight bars adapted to receive the stringers longitudinally thereon, pairs of confronting chucks on the flight bars adapted to receive opposite ends of the stringers therein to advance the stringers longitudinally into the nailing station; and which machine has arcuate displacing means disposed in the path of the slats when the advancing means is reversed to deflect the slats from the reversed advancing means to displace the stringers from their chucks.

3. The machine of claim 1 in which said advancing means is reversible to retract the nailed slats and stringers and is adapted to receive the retracted nailed slats and stringers in inverted position and to advance the inverted stringers longitudinally in increments of stepped progression into the nailing station whereby predetermined slat receiving positions on the inverted stringers are successively located in the nailing station, in which the pusher automatically supplies slats to a ready position upwardly adjacent to the receiving positions of the inverted stringers in the nailing station, and in which the nailing means drives the slats from the ready position downwardly to the slat receiving positions on the inverted stringers while positioned in the nailing station and nails the same.

4. The machine of claim 3 in which the advancing means comprises flight bars mounted for reciprocal movement along a path to and from the nailing station disposed transversely of the path, confronting chucks mounted in spaced relation aligned longitudinally of the path on the flight bars adapted to receive opposite ends of the stringers therein to advance the stringers into the nailing station to have the slats nailed thereto and to retract the stringers and nailed slats from the nailing station, the chucks supporting the stringers with the slats nailed thereto with the slats upwardly spaced from the flight bars, and a pair of ramps disposed in substantially parallel erect planes aligned with the path having lower ends disposed at a height to pass between the flight bars and slats during such retraction and arcuately upwardly curved therefrom to lift the leading slat being retracted to draw the adjacent ends of the stringers from their chucks to facilitate removal and/or inversion of the stringers and slats nailed thereto.

5. A machine, for nailing elongated slats transversely on elongated stringers; comprising a nailing station; a receiving station; a reversible conveyor extended between said stations, chuck means on the conveyor adapted to grasp a first set of stringers in substantially parallel relation disposed longitudinally of the conveyor with the stringers having upper surfaces disposed in a common horizontal plane to receive slats thereon, and said chuck means also being adapted simultaneously to grasp a slat disposed transversely of the conveyor having inverted stringers to which the slat is nailed supported thereon and extended longitudinally of the conveyor substantially aligned with the first set of stringers with said inverted stringers having upper surfaces disposed in said common horizontal plane to receive slats thereon; reversible drive means for advancing the conveyor toward the nailing station in increments of stepped progression whereby corresponding spaced positions on the stringers are successively disposed in the nailing station; means for automatically placing slats at a ready station adjacent to the nailing station synchronously with movement of the spaced positions on the stringers into the nailing station; and means for forcing the slats successively from the ready station transversely onto the stringers at said spaced positions and for nailing the slats to the stringers at said spaced positions on the stringers whereby the stringers are interconnected in spaced substantially parallel relation.

6. A machine for nailing elongated slats of predetermined thickness transversely on elongated stringers to form half pallets and subsequently nailing elongated slats on the half pallets to form full pallets comprising:

A. a table having a nailing station and a receiving station;

B. a reversible conveyor extended between said stations;

C. chuck means on said conveyor adapted to support and transport a first set of stringers in substantially parallel relation longitudinally of the upper run of the conveyor spaced upwardly from the table a distance substantially equal to the thickness of a slat and said chuck means also being adapted simultaneously to engage a slat of an inverted half pallet disposed transversely of the conveyor and slidably supported on the table with the stringers to which it is nailed disposed longitudinally of the conveyor in substantial alignment with respective stringers of the first set; reversible drive means for advancing the conveyor toward the nailing station in increments of stepped progression whereby corresponding spaced positions on the stringers of the half pallet and of the first set are successively disposed in the nailing station; means for successively placing slats transversely disposed and upwardly spaced from the stringers at said spaced positions; means for forcing the slats downwardly onto the stringers and nailing the slats to the stringers at said spaced positions on the stringers at the nailing station whereby the half pallet is completed and the first set of stringers form a half pallet.

7. The machine of claim 6 in which the means for successively placing slats transversely disposed and upwardly spaced from the stringers comprises a hopper adapted to hold slats in horizontal stacked relation adjacent to the nailing station and above the stringers with the lowermost slat disposed in a substantially horizontal plane, a pusher mounted for reciprocal movement in said plane successively to slide the lowermost slats from said stack into a ready station above the stringers, and means for operating the pusher synchronously with the increments of stepped progression of the advancing means to deliver such slats to the ready position and the forcing and nailing means synchronously thrusts the slats from the ready position onto the stringers as said positions reach the nailing station.

8. The machine of claim 7 in which the pusher slides the slats successively edgewardly horizontally to the ready position over the slat receiving positions of the stringers in the nailing station, and includes a substantially horizontal shelf under each end portion of said ready position adapted to receive opposite end portions of the slats thereon, said shelves being pivotally mounted for movement about substantially horizontal axes adjacent to respective ends thereof, resilient means urging the shelves into their substantially horizontal positions but permitting the shelves to pivot downwardly when the resilient means is overcome, and in which the nailing means forces the slats individually successively downwardly in opposition to the resilient means whereby as the shelves tip downwardly they position the slats in their receiving positions transversely on the stringers.

9. In a machine for nailing elongated slats transversely on opposite surfaces of elongated stringers, which machine has an elongated table providing a predetermined forward end and a rearward end; a feed mechanism comprising:

A. a reversible conveyor extended longitudinally of the table;

B. a plurality of leading chucks mounted on the conveyor in spaced relation substantially aligned transversely of the table having rearwardly disposed sockets and forwardly disposed pusher means;

C. a plurality of trailing chucks mounted on the conveyor in spaced relation substantially aligned transversely of the table and individually respectively aligned with the leading chucks longitudinally of the table and having forwardly disposed sockets, the sockets of the longitudinally aligned chucks being adapted to receive opposite ends of stringers therein for the nailing of the slats to a first side of the stringers and the table being adapted to receive the stringers inverted with the slats nailed to the first side thereof slidably rested on the table with a rear slat engaged with the pushing means of the leading chucks for the nailing of further slats to an opposite side of the stringers; and D. resilient means for releasably clasping said rear slat against said pushing means when the stringers and slats nailed to the first side thereof are inverted.

10. The feed mechanism of claim 9 for slats of predetermined thickness in which the sockets of the chucks have floors which support the stringers received therein upwardly spaced from the table substantially the thickness of the slats.

11. The feed mechanism of claim 10 in which there is an auxiliary flight bar substantially the thickness of the slats slidably supported on the table interconnecting the chains between the flight bars mounting the chucks to support the stringers as the slats are nailed thereto.

12. The feed mechanism of claim 9 in which the conveyor comprises a pair of substantially parallel endless chains extended along opposite sides of the table, each having an upper run above the table and a lower run below the table; and flight bars interconnecting the chains, the leading chucks being mounted on one flight bar and the trailing chucks being mounted on a separate flight bar rearwardly thereof.

13. The feed mechanism of claim 9 in which the pusher means on the leading chucks comprise rollers mounted on their respective chucks for rotation about substantially horizontal axes.

14. The feed mechanism of claim 9 in which each of the sockets of the trailing chucks is upwardly open to receive an end of a stringer thrust downwardly therein and each such trailing chuck has a cutter, means mounting the cutter adjacent to a side of the socket in a fixed plane transversely of the table, and resilient means for urging the cutter in the plane into the socket whereby when a stringer is thrust downwardly in the socket the cutter scores the stringer and resists longitudinal displacement of the stringer from desired position in the socket.

15. The feed mechanism of claim 14 in which the cutter is a circular knife mounted for rotation in said plane.

16. In a pallet making machine in which elongated slats of predetermined thickness are nailed in transversely interconnecting relation to elongated stringers successively on upper and lower surfaces thereof, which machine has a table providing receiving and inverting stations and a nailing station, means at the nailing station for positioning slats on the stringers, and means at the nailing station for nailing the slats on the stringers; a stringer feed mechanism comprising:

A. an endless conveyor having an upper run above the table extended between the receiving station and the nailing station and a lower return run below the table; the conveyor having a predetermined forward direction of travel in which the upper run moves toward the nailing station and a rearward direction of travel in which the upper run moves toward the receiving and inverting stations;

B. a plurality of leading chucks mounted on the conveyor in spaced relation transversely thereof, each having a forwardly disposed wall and a rearwardly disposed socket;

C. a plurality of trailing chucks mounted on the conveyor individually rearwardly aligned with the leading chucks, each having a forwardly disposed socket, the aligned chucks having sockets adapted to receive opposite ends of stringers therein and the sockets having floors upwardly spaced from the table substantially the thickness of the slats to support the stringers upwardly spaced from the table; and D. drive means for sequentially 1. advancing the conveyor forwardly in increments of stepped progression to bring successive corresponding positions of the stringers into the nailing station where the slats are positioned on the stringers and nailed thereon, 2. reversing the conveyor to retract the stringers with the slats nailed on the upper surfaces thereof to the receiving and inverting stations, said table being adapted to receive the stringers with the slats thereon in inverted position at the inverting station with the slats slidably rested on the table and with a slat disposed to be pushed forwardly by the leading chucks and the aligned chucks being adapted to receive a new set of stringers at the loading station, 3. advancing the conveyor forwardly in increments of stepped progression to bring successive corresponding positions of the inverted stringers into the nailing station where additional slats are positioned on said stringers and nailed thereon, and 4. continuing to advance the conveyor forwardly in increments of stepped progression to discharge a completed pallet while successive corresponding positions on the following new set of stringers are located in the nailing station.

17. The feed mechanism of claim 16 in which each of the trailing chucks has a rotary knife mounted thereon for rotation in a plane transversely of the conveyor and reciprocal movement toward and from its respective socket, and resilient means urging the knife toward the socket so as to engage stringers received therein to resist longitudinal displacement thereof.

18. In combination with the feed mechanism of claim 16; a ramp mounted in a substantialy erect plane disposed longitudinally of the conveyor at the inverting station having an end in adjacent spaced relation to the table to pass under the rearward slat nailed on the stringers as the reversed conveyor moves such stringers with the slats nailed thereon to the inverting station, said ramp being arcuately upwardly extended to remove the stringers from said trailing chucks and initiate their inversion.

19. A machine for nailing elongated slats transversely on elongated stringers comprising:

A. a substantially horizontal table having a inverting station and a nailing station;

B. a pair of substantially parallel endless chains each having an upper run above the table extended between said stations and a lower run below the table;

C. flight bars interconnecting the chains;

D. leading chucks mounted on a common flight bar;

E. trailing chucks mounted on a common flight bar is spaced relation to the flight bar mounting the leading chucks, the leading and trailing chucks being disposed in pairs aligned in substantially parallel relation to the chains and spaced to receive stringers therebetween with opposite ends of the stringers engaged in respective chucks;

F. reversible drive means for correspondingly driving the chains in increments of stepped progression to position corresponding successive portions of the stringers in the nailing station;

G. means for delivering slats to said successive portions of the stringers while they are in the nailing station;

H. means for nailing the slats to the stringers in the nailing station;

I. means for reversing the drive means after the slats have been nailed to said successive portions of the stringers to carry the slats and stringers along the table from the nailing station to the receiving station; and J. an arcuate ramp mounted above the table at the inverting station having an end disposed in sufficiently spaced relation to the table for the passage of the flight bars thereunder to the lower run of the chains but in sufficient proximity to the table to engage under the slats traveled theretoward, said lifting means being arcuately upwardly extended in the reversed direction of travel of the upper runs of the chains to lift the engaged slats and remove the stringers to which they are nailed from the trailing chucks.

20. In a nailing machine, the combination of predetermined nail picking stations, means individual to the picking stations for organizing bulk nails into rows for successive delivery to their respective picking stations, nail delivery means individual to the picking stations having nail receiving inlets adjacent to such stations, nail picks individual to the stations mounted for oscillating movement between their respective stations and said stations' respective inlets and return so as to transport nails one at a time from the stations to the inlets, resilient means urging the picks into their respective stations, drive means engaging the picks operable to release their respective picks for oscillation toward their stations under the urging of their resilient means and engageable with their respective picks positively to return the picks to their respective inlets against the urging of the resilient means, and control means operable to engage selected nail picks to retain their respective picks at their inlets whereby only predetermined nail delivery means are supplied with nails.

21. The combination of claim 20 in which the picks are pivotally mounted for said oscillating movement in a row and the control means comprises a lockout shaft mounted adjacent to the row, and fingers on the lockout shaft adjacent to predetermined picks, said shaft being moveable to bring the fingers into blocking relation to their respective picks to retain the picks at their respective inlets and retractable therefrom to free their respective picks for oscillation to their stations when released by the drive means.

22. The combination of claim 2 in which the picks have cams individual thereto and the drive means includes an operating shaft mounted for oscillation adjacent to the picks, and cam followers on the oscillated operating shaft individual to the picks engageable with the cams positively to pivot the picks to their respective inlets upon rotation of the shaft in one direction and to release the picks for resilient return to their respective picking stations upon rotation of the oscillated shaft in the opposite direction.

23. A machine for forming pallets by nailing slats of predetermined thickness onto stringers comprising:

A. an elongated table;

B. a conveyor having an upper run providing forward and rearward flight bars disposed transversely of the table;

C. forward and rearward chucks on the flight bars, the chucks being aligned in pairs longitudinally of the table and said chucks being adapted to receive stringers in substantially parallel relation therein extended longitudinally of the table, the chucks having floors providing stringer supporting surfaces spaced upwardly from the table a distance substantially equal to the thickness of a slat;

D. reversible means for advancing the conveyor and elongated stringers longitudinally in corresponding increments of stepped progression into a nailing station on the table whereby predetermined slat receiving positions on the stringers are successively located in the nailing station;

E. means for automatically supplying slats in the nailing station to the slat receiving positions on the stingers in transversely interconnecting relation to the stringer;

F. means for nailing the slats to the slat receiving positions on the stringers while the slats are positioned thereon in the nailing station to form a half pallet;

G. means for reversing the advancing means to retract the half pallet from the nailing station along a predetermined path to an inverting station;

H. means for releasably clamping a slat of an inverted half pallet edgewardly against the forward chucks with the slats of the half pallet rested flatly against the table and the stringers forwardly extended from the chucks, the forward and rearward chucks being adapted to receive a new set of stringers therein extended longitudinally of the table supported on the floor of the chucks upwardly spaced from the table a distance substantially equal to the thickness of a slat, said advancing means being adapted to advance the half pallet in increments of stepped progression successively to locate the predetermined slat receiving positions of the stringers of the inverted half pallet in the nailing station followed by the successive positioning of predetermined slat receiving positions on the second set of stringers in said nailing station, the slat supplying means being operable to supply slats to the slat receiving positions on the inverted stringers of the half pallet and the stringers of the new set as they are successively located in the nailing station in transversely interconnecting relation to said stringers and the nailing means being operable to nail the slats to the inverted stringers of the half pallet and the stringers of the new set as they are supplied thereto in the nailing station to form a complete pallet of the half pallet and a half pallet of the new set of stringers and their slats.

* * * * *

UNITED STATES PATENT AND TRADEMARK OFFICE

CERTIFICATE OF CORRECTION

PATENT NO. : 4,054,236

DATED : October 18, 1977

INVENTOR(S) : Gerald C. Paxton

It is certified that error appears in the above-identified patent and that said Letters Patent are hereby corrected as shown below:

Column 1, Line 35, between "first" and "station" insert ---nailing---.

Column 3, Line 47, before "rectangle" delete "the" and insert ---a---.

Column 4, Line 1, between "bearing" and "sprocket" delete "the" and insert ---and---.

Column 5, Line 29, delete "slots" and substitute ---slot---.

Column 7, Line 27, delete "exensions" and insert ---extensions---.

Line 48, delete "tube" and substitute ---tubes---.

Line 55, delete "the" in the first instance and substitute ---each---.

Column 8, Line 57, delete "feed" and insert ---feeder---.

Column 9, Line 33, between "into" and "screw" insert ---new---.

Column 21, Line 67, after "clutch" delete "switched" and insert ---switch---.

UNITED STATES PATENT AND TRADEMARK OFFICE

CERTIFICATE OF CORRECTION

PATENT NO. : 4,054,236
DATED : October 18, 1977
INVENTOR(S) : Gerald C. Paxton

It is certified that error appears in the above-identified patent and that said Letters Patent are hereby corrected as shown below:

Column 23, Line 9, between "right" and "Fig." insert ---of---.

Column 24, Line 68, after "stations" delete the coma and insert ---;---.

Column 27, Line 57, delete "surfaces" and insert ---surface---.

Column 28, Line 34, after "bar" delete "is" and insert ---in---.

Column 29, Line 28, after "claim" delete "2" and insert -- 21 --.

Column 30, Line 11, delete "stingers" and insert ---stringers---.

Line 12, pluralize "stringer".

Line 28, pluralize "floor".

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*